US011400506B2

(12) United States Patent
Kohno et al.

(10) Patent No.: US 11,400,506 B2
(45) Date of Patent: Aug. 2, 2022

(54) DOUBLE-BLANK DETECTING APPARATUS FOR PRESS MACHINE AND DIE PROTECTING APPARATUS FOR PRESS MACHINE

(71) Applicant: AIDA ENGINEERING, LTD., Kanagawa (JP)

(72) Inventors: Yasuyuki Kohno, Kanagawa (JP); Junji Makabe, Kanagawa (JP); Ryosho Iwamura, Kanagawa (JP)

(73) Assignee: AIDA ENGINEERING, LTD., Kanagawa (JP)

( * ) Notice: Subject to any disclaimer, the term of this patent is extended or adjusted under 35 U.S.C. 154(b) by 173 days.

(21) Appl. No.: 16/414,244

(22) Filed: May 16, 2019

(65) Prior Publication Data

US 2019/0358692 A1 Nov. 28, 2019

(30) Foreign Application Priority Data

May 28, 2018 (JP) ..... JP2018-101632

(51) Int. Cl.
*B21D 24/14* (2006.01)
*B21D 24/02* (2006.01)
(Continued)

(52) U.S. Cl.
CPC ..... *B21D 24/14* (2013.01); *B21D 24/02* (2013.01); *B21D 24/08* (2013.01); *B21D 43/025* (2013.01); *B21D 55/00* (2013.01); *B30B 15/281* (2013.01)

(58) Field of Classification Search
CPC ..... B21D 24/02; B21D 24/08; B21D 24/14; B21D 43/00; B21D 43/02; B21D 43/025;
(Continued)

(56) References Cited

U.S. PATENT DOCUMENTS 5,361,615 A 11/1994 Kirii et al.
5,692,405 A 12/1997 Kirii
(Continued)

FOREIGN PATENT DOCUMENTS

CN 1114599 A 1/1996
CN 101979241 A 2/2011
(Continued)

OTHER PUBLICATIONS

Japanaese Office Action issued in corresponding Japanese Patent Application No. 2018-101632, dated Jun. 29, 2020, with English translation.

(Continued)

*Primary Examiner* — Jessica Cahill
*Assistant Examiner* — Smith Oberto Bapthelus
(74) *Attorney, Agent, or Firm* — McDermott Will & Emery LLP

(57) ABSTRACT

A double-blank detecting apparatus for a press machine that is provided with a die cushion apparatus and is configured to form blanks one by one automatically and repeatedly. The double-blank detecting apparatus includes: a position signal acquiring unit configured to acquire a slide position signal indicating a position of a slide of the press machine; a load signal acquiring unit configured to acquire a die cushion load signal indicating a die cushion load generated on a cushion pad of the die cushion apparatus; and a double-blank detector configured to detect a state in which a plurality of blanks are stacked as a double blank based on the slide position signal acquired by the position signal acquiring unit and the die cushion load signal acquired by the load signal acquiring unit.

8 Claims, 18 Drawing Sheets

(51) Int. Cl.

| | |
|---|---|
| ***B21D 24/08*** | (2006.01) |
| ***B21D 55/00*** | (2006.01) |
| ***B30B 15/28*** | (2006.01) |
| ***B21D 43/02*** | (2006.01) |

(58) Field of Classification Search
CPC ..... B30B 15/14; B30B 15/148; B30B 15/026; B30B 15/26; B30B 15/28; B30B 15/285; B30B 15/281; B30B 15/16; B30B 15/282; B30B 15/009
USPC ..... 72/4
See application file for complete search history.

(56) References Cited

U.S. PATENT DOCUMENTS

| | | | |
|---|---|---|---|
| 2009/0071218 | A1 | 3/2009 | Kohno et al. |
| 2016/0074920 | A1 | 3/2016 | Kohno |

FOREIGN PATENT DOCUMENTS

| | | | | |
|---|---|---|---|---|
| CN | 205270511 | U | | 6/2016 |
| EP | 3412372 | A1 | | 12/2018 |
| JP | S49-86965 | A | | 8/1974 |
| JP | S55-117599 | A | | 9/1980 |
| JP | S58-111131 | U | | 7/1983 |
| JP | H05-285555 | A | | 11/1993 |
| JP | 10193199 | A | | 7/1998 |
| JP | H11-58097 | A | | 3/1999 |
| JP | H1158097 | A | * | 3/1999 |
| JP | 2006315074 | A | | 11/2006 |
| JP | 2010-042442 | A | | 2/2010 |
| JP | 2010042442 | A | * | 2/2010 |

OTHER PUBLICATIONS

Notice of Reasons for Refusal issued in corresponding Japanese Application No. 2018-101632, dated Mar. 16, 2020, with English translation.
Extended European Search Report issued in corresponding European Patent Application No. 19174797.1, dated Nov. 14, 2019.
Office Action for Chinese Patent Application No. 201910431994.5, dated Mar. 3, 2022. 14 pages.

* cited by examiner

DOUBLE-BLANK DETECTING APPARATUS FOR PRESS MACHINE AND DIE PROTECTING APPARATUS FOR PRESS MACHINE

CROSS-REFERENCE TO RELATED APPLICATIONS

The present application claims priority under 35 U.S.C. § 119 to Japanese Patent Application No. 2018-101632, filed on May 28, 2018. The above application is hereby expressly incorporated by reference, in its entirety, into the present application.

BACKGROUND OF THE INVENTION

Field of the Invention

The present invention relates to a double-blank detecting apparatus for a press machine and a die protecting apparatus for a press machine, and in particular to a technique to reliably detect a "double blank" when multiple blanks are supplied to the press machine.

Description of the Related Art

In the related art, a system that detects the double blank of this kind is disclosed in Japanese Patent Laid-Open No. H10-193199.

In a case where a blank (workpiece) is formed by using a direct-acting-type press machine in which a hydraulic cylinder for moving a slide upward and downward is driven by a servo valve, a die protecting apparatus for the direct-acting-type press described in Japanese Patent Laid-Open No. H10-193199 detects a slide position when a press load signal (calculated from a pressure signal for descending the hydraulic cylinder and a pressure signal for ascending the hydraulic cylinder) rises rapidly at a timing to start forming, determines that the double blank occurs when the detected slide position is out of a plate thickness tolerance (a plate thickness tolerance set based on a reference plate thickness position with respect to a single workpiece), and moves the slide in a direction opposite to a direction for a pressing process. Note that the direct-acting-type press machine described in Japanese Patent Laid-Open No. H10-193199 is not provided with a die cushion apparatus.

Patent Literatures

Patent Literature 1: Japanese Patent Application Laid-Open No. H10-193199

SUMMARY OF THE INVENTION

A method of detecting the double blank in Japanese Patent Laid-Open No. H10-193199 includes: detecting a press load and a slide position; detecting the slide position where the press load rises rapidly at a timing to start forming; and determines that the double blank occurs when the detected slide position is out of the plate thickness tolerance. However, the method has the following disadvantages because the double blank is detected based on the slide position where the press load rises rapidly (that is, the slide position detected with reference to the press load).

A first disadvantage in using the press load is that the press load signal indicating the press load becomes complex because the press load is a sum of the die cushion load and a forming load (Disadvantage A).

Accordingly, forming factors easily fluctuate due to individual difference (in features such as thickness and hardness) of blanks, and even in the normal state, the timing of rapid rising of the press load varies significantly, which makes it difficult to detect abnormality (double blank).

A second disadvantage in using the press load is that the press machine is heavier and larger than the die cushion apparatus (that is, the frame of the press machine easily expands and contracts) and typically has a small eigenfrequency (natural frequency), and thus the press load is more susceptible to the eigenfrequency (excited by a press load acting impulsively at the timing when the press load starts to act) (Disadvantage B).

When the eigenfrequency component is included in the press load signal, the abnormality (double blank) detection becomes difficult.

A third disadvantage in using the press load is that a resolution of the press load signal is rough (Disadvantage C). In a press machine provided with the die cushion apparatus, a ratio of a press (maximum allowable) load with respect to a die cushion (maximum) load of is generally within a range from 3:1 to 6:1. If the same load detector is used for detecting the press load and for detecting the die cushion load, the resolution of the press load signal is at least one-third or lower with respect to the resolution of the die cushion load signal, and thus accuracy of abnormality (double blank) detection deteriorates correspondingly.

The present invention has been made under such circumstances and aims to provide a double-blank detecting apparatus for a press machine and a die protecting apparatus for a press machine which are capable of reliably detecting a double blank when multiple blanks are supplied to the press machine.

In order to achieve the above described object, the invention according to an aspect is a double-blank detecting apparatus for a press machine that is provided with a die cushion apparatus and forms blanks one by one automatically and repeatedly, the double-blank detecting apparatus including: a position signal acquiring unit configured to acquire a slide position signal indicating a position of a slide of the press machine; a load signal acquiring unit configured to acquire a die cushion load signal indicating a die cushion load generated on a cushion pad of the die cushion apparatus; and a double-blank detector configured to detect a state in which a plurality of blanks are stacked as a double blank based on the slide position signal acquired by the position signal acquiring unit and the die cushion load signal acquired by the load signal acquiring unit.

According to one aspect of the present invention, a die cushion load is detected instead of detection of the press load described in Japanese Patent Laid-Open No. H10-193199, and a double blank is detected based on the slide position signal indicating the position of the slide and the die cushion load signal indicating the die cushion load.

The die cushion load signal is simpler than the press load signal which is a sum of the die cushion load and the forming load. The die cushion load signal is highly stable against the rapid rising of the die cushion load. In addition, the press machine is heavier, thicker and longer than the die cushion apparatus, and the eigenfrequency frequency excited by the press load acting impulsively at the time of starting an action of the press load is smaller in the press machine than in the die cushion apparatus. As regards the press load, since an eigenfrequency frequency of the press machine is smaller than the eigenfrequency frequency of the die cushion apparatus, the press load signal is susceptible to the eigenfrequency correspondingly. In contrast, the die cushion load signal is less susceptible to the eigenfrequency than the press load signal. In addition, when the same load detector is used, since the die cushion load is smaller than the press load, the resolution of the die cushion load signal is higher than the resolution of the press load signal correspondingly.

The slide position signal at a timing when the die cushion load signal rises tends normally to have a constant value in a normal state (during production without any abnormality). The reason is that the die cushion apparatus exhibits a single spring characteristic (inherent elasticity at least at the die cushion load starting time), and the die cushion position (displacement) is substantially proportional to the die cushion load. In addition, the die cushion load signal has high responsiveness and detection accuracy. Utilizing these features, when the plate thickness of the blank is changed (two or more blanks are stacked), a double blank can be detected quickly (immediately after the start of forming) and reliably (without detection failure) based on a change of the slide position at a timing when a certain (relatively small) die cushion load began to be generated.

In the double-blank detecting apparatus according to another aspect of the present invention, it is preferable that the double-blank detector holds the slide position signal at a timing when the die cushion load signal rises to a predetermined value as a slide position signal hold value, compares the held slide position signal hold value and an abnormality determination value, and detects the double blank in a case where the held slide position signal hold value is equal to or larger than the abnormality determination value. In the normal state, since the slide position signal hold value at a timing when the die cushion load signal rises to a certain (predetermined) value is stable, the abnormality (double blank) can be detected reliably based on the change (variation) in the slide position signal hold value equal to or larger than the abnormality determination value.

In the double-blank detecting apparatus according to still another aspect of the present invention, the abnormality determination value is set so as to satisfy conditions of $$Y \geq (X_{AVE}+0.3T) \text{ and } Y<(X_{AVE}+T)$$

in which Y is the abnormality determination value, $X_{AVE}$ is an average value of slide position signal hold values obtained by repeating forming of one blank by a plurality of times, and T is a plate thickness of the blank.

The slide position signal hold value at a timing when the die cushion load signal rises to the predetermined value corresponds to a position higher than the position in the normal state by an amount corresponding to the thickness of a single blank when a double blank is detected. In other words, the slide position signal hold value is larger than the average value $X_{AVE}$.

Therefore, the abnormality determination value Y is set within a range of a value obtained by adding an amount of variation (equal to or higher than 30% and lower than 100% of the plate thickness T of the blank) to the average value $X_{AVE}$ of the slide position signal hold value. Then, in a case where the slide position signal hold value is equal to or larger than the abnormality determination value Y, it is determined that the double blank is detected. Thus, the double blank (two or more blanks) can be reliably detected.

In the double-blank detecting apparatus according to still another aspect of the present invention, the abnormality determination value is set so as to satisfy conditions of $$Y<X', \text{ and } Y \geq (X'-0.7T)$$

in which Y is the abnormality determination value, X' is a slide position signal hold value obtained by testing forming of two stacked blanks, and T is a plate thickness of the blank.

The abnormality determination value Y is set within a range of a value obtained by subtracting an amount of variation (higher than 0% and equal to or lower than 70% of the plate thickness T of the blank) from the slide position signal hold value X' obtained when the stacked two blanks are used. Then, in a case where the slide position signal hold value is equal to or larger than the abnormality determination value Y, it is determined that the double blank is detected. Thus, the double blank can be reliably detected.

It is preferable that the double-blank detecting apparatus according to still another aspect of the present invention includes a first manual setting unit configured to set the abnormality determination value manually or a first automatic setting unit configured to automatically calculate and set the abnormality determination value.

In the double-blank detecting apparatus according to still another aspect of the present invention, it is preferable that the predetermined value of the die cushion load signal is a value within a range 5% or more and 20% or less of the maximum die cushion load of the die cushion apparatus.

It is preferable that the predetermined value of the die cushion load signal within a range from 5% to 20% inclusive of the maximum die cushion load in order to reliably detect the change of the die cushion load signal as early as possible.

It is preferable that the double-blank detecting apparatus according to still another aspect of the present invention includes a second manual setting unit configured to set the predetermined value of the die cushion load signal manually or a second automatic setting unit configured to automatically calculate and set the predetermined value of the die cushion load signal based on the maximum die cushion load of the die cushion apparatus.

It is preferable that the double-blank detecting apparatus according to still another aspect of the present invention includes: a slide position detector configured to detect the position of the slide of the press machine and output the slide position signal; and a die cushion load detector configured to detect the die cushion load generated on the cushion pad and output the die cushion load signal, wherein the position signal acquiring unit acquires the slide position signal from the slide position detector and the load signal acquiring unit acquires the die cushion load signal from the die cushion load detector.

The slide position signal and the die cushion load signal can be acquired respectively from the press machine and the die cushion apparatus, and there is no need to add a detector for detecting these signals. Therefore, a double-blank detecting apparatus is achieved at low cost.

An invention according to another aspect is a die protecting apparatus for a press machine which is provided with a die cushion apparatus and forms blanks one by one automatically and repeatedly, the press machine including a braking apparatus configured to apply brake on a slide driven by a press driving apparatus of the press machine, and a hydraulic cylinder integrated in the slide and configured to move a die mounting surface of the slide relatively to a movement of the slide driven by the press driving apparatus, the die protecting apparatus including: the double-blank detecting apparatus according to above aspects; and a safeguard apparatus configured to cause the braking apparatus to start a sudden braking of the slide and depressurize the hydraulic cylinder to relatively move a part of the slide including the die mounting surface in an ascending direction when double blank is detected by the double-blank detector.

When the double blank is detected by the double-blank detector, the braking apparatus starts sudden braking of the slide. For example, in the case where the press machine is a servomotor driven type, a maximum torque is applied in the braking direction to the servomotor to apply sudden braking. Even though the sudden braking is started, a limited time is required for stopping the slide due to inertia of the slide or the like, and thus forming progresses during this time. Consequently, a risk to damage the die increases. Considering the problem, in the die protecting apparatus, in addition to starting the sudden braking, the hydraulic cylinder integrated in the slide is depressurized immediately to allow the part of the slide including the die mounting surface to move relatively in the ascending direction. Accordingly, before forming starts, the slide (die) is safely stopped. Consequently, the die is prevented from being damaged (the die is protected).

An invention according to further another aspect is a press machine which forms blanks one by one automatically and repeatedly, the press machine including: the die protecting apparatus according the above aspects; and a die cushion apparatus, wherein the die cushion apparatus includes: a die cushion driving unit configured to support a cushion pad, move the cushion pad upward and downward, and generate a die cushion load on the cushion pad; a die cushion load command unit configured to output a die cushion load command; and a die cushion load controller configured to control the die cushion driving unit based on the die cushion load command output from the die cushion load command unit to generate on the cushion pad, a die cushion load corresponding to the die cushion load command, wherein, in a case where the double blank is detected by the double-blank detector, and only when the cushion pad is in a region where forming does not start, of a region where the cushion pad moves, and the die cushion load command unit outputs a predetermined die cushion load command until the slide stops, make the hydraulic cylinder contract by a die cushion load generated on the cushion pad in accordance with the die cushion load command to move a part of the slide including a die mounting surface relatively in an ascending direction.

The hydraulic cylinder integrated in the slide retracts by a contracting action of the hydraulic cylinder encouraged by a die cushion load applied from the cushion pad, and the part of the slide including the die mounting surface moves relatively in the ascending direction in association with the retraction of the hydraulic cylinder. The die cushion load command unit outputs a predetermined die cushion load command only when in a region where forming does not start during a period until the slide stops. In contrast, when a double blank is detected, because the double blank is an extremely dangerous state for the die, the die cushion load is basically not applied in a press-forming region.

In the press machine according to the further another aspect, it is preferable that the die cushion apparatus includes: a die cushion position command unit configured to output a die cushion position command; and a die cushion position controller configured to control the die cushion driving unit based on the die cushion position command output from the die cushion position command unit after the die cushion load control by the die cushion load controller is finished, to move the cushion pad upward to a predetermined die cushion standby position, wherein the predetermined die cushion standby position is a position shifted in the ascending direction by a predetermined amount from a position where forming starts. This is to secure a stop time for the slide (the amount of downward movement of the die mounting surface of the slide) before starting the forming when the double blank is detected.

In the press machine according to the further another aspect, the region where the forming is not started is a region between the predetermined die cushion standby position and the position where the forming starts.

In the press machine according to the further another aspect, it is preferable that the die cushion load command unit automatically outputs a maximum die cushion load command as the predetermined die cushion load command when the double blank is detected by the double-blank detector.

This is to apply the maximum die cushion load to the slide including the hydraulic cylinder integrated therein when the double blank is detected, thereby causing the hydraulic cylinder to retract as quick as possible so that the forming is not started.

According to the present invention, in a case where multiple blanks are supplied to a press machine, a double blank abnormality can be reliably detected because a die cushion load which can be detected with high accuracy is used for detecting the double blank.

DETAILED DESCRIPTION OF THE PREFERRED EMBODIMENT

Referring now to the attached drawings, a preferred embodiment of a double-blank detecting apparatus for a press machine and a die protecting apparatus for the press machine according to the present invention will be described in detail below.

Figure 1:
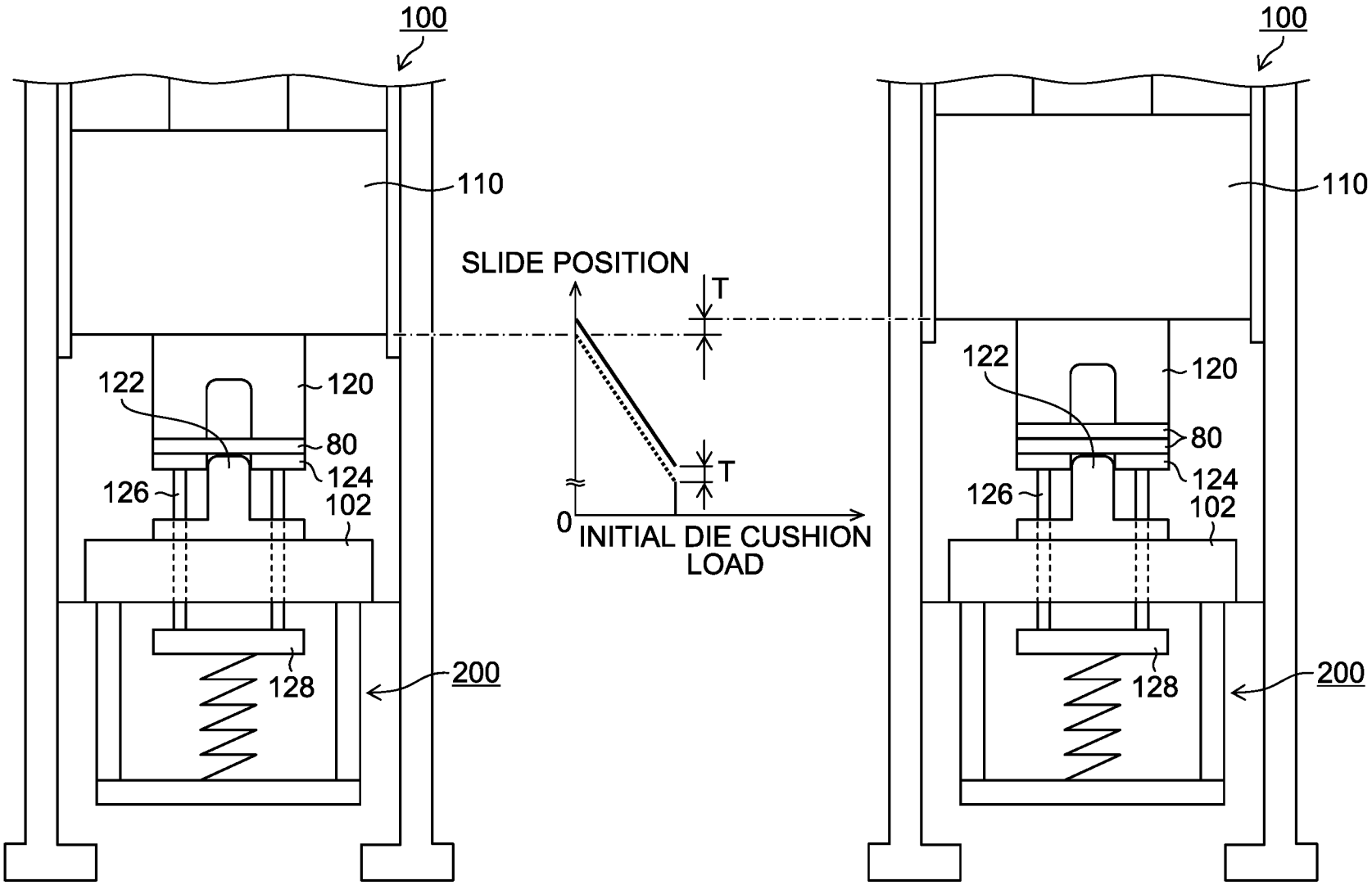
FIG. 1 is an explanatory drawing illustrating a principle of detection of a double blank in a double-blank detecting apparatus according to the present invention.

FIG. 1 is an explanatory drawing illustrating a principle of detection of a double blank in a double-blank detecting apparatus according to the present invention.

A left side of the drawing in FIG. 1 illustrates a press machine 100 in normal state to which one blank material (hereinafter referred to as "blank") is supplied. A right side of the drawing in FIG. 1 illustrates the press machine 100 in a double-blank state (abnormal state) to which two blanks are supplied. Both the right side and the left side of the drawing illustrate the press machine 100 at a die cushion load action starting time, that is, at a time when the die cushion load starts to act from the states illustrated in FIG. 1.

In FIG. 1, the press machine 100 is a so-called mechanical servo press in which a slide 110 is driven by a servomotor, which will be described later, via a crankshaft and a connecting rod. The press machine 100 is configured to draw a thin plate-like blank 80 between an upper die 120 mounted on a die mounting surface of the slide 110 and a lower die 122 mounted on an upper surface of a bolster 102. In this example, the press machine 100 forms the blank 80 having a large size such as an automobile body forming and the like.

A die cushion apparatus 200 is configured to press and hold a peripheral edge of the blank 80 to be formed by the press machine 100 between the upper die 120 and a blank holder (blank holding plate) 124. The blank holder 124 is held by a cushion pad 128 via a plurality of cushion pins 126. The die cushion apparatus 200 has a driving system for generating a die cushion load (force) on the cushion pad 128. Such a driving system may include an air cylinder driving system, a hydraulic cylinder driving system using a hydraulic servo valve, a hydraulic cylinder driving system (Japanese Patent Application Laid-Open No. 2006-315074) using a hydraulic pump/motor axially connected to a shaft of a servomotor, and a screw-nut driving system using a servomotor. Irrespective of the type of the driving system, various types of die cushion apparatuses exhibit one spring characteristic (at least inherent elasticity at the die cushion load starting time), and the position (displacement) of the die cushion is substantially proportional to the die cushion load. Here, FIG. 1 illustrates that the die cushion apparatus 200 has a spring characteristic irrespective of its driving system.

When the slide 110 moves further downward from the state illustrated in FIG. 1 (from the die cushion load stating time, that is, when the slide 110 comes into contact with the cushion pad 128 via the upper die 120, the blank 80, the blank holder 124 and the cushion pins 126, and the die cushion load starts to act), a die cushion load is generated in proportion to the slide position (displacement) of the cushion pad 128 pressed indirectly downward by the slide 110 in an initial stage of die cushion load action in both states shown on the left and the right sides of FIG. 1, as illustrated in a graph in a middle of FIG. 1. In other words, the slide displacement and the initial die cushion load are the same in the states shown on the left and the right sides of FIG. 1. The reason is that the spring characteristic of the die cushion apparatus 200 is identical.

In contrast, the die cushion load starts to act from a slide position (position of the slide 110) higher by a plate thickness (T) of the blank 80 than an original slide position. Therefore, the slide position when the die cushion load reaches a predetermined value (initial die cushion load) is higher in the state shown on the right side of FIG. 1 than in the state shown on the left side of FIG. 1 by the plate thickness T of one blank.

Therefore, the present invention detects the double blank from a difference of the slide position at a timing when the die cushion load rises to the predetermined value based on the slide position signal which indicates the position of the slide 110 and the die cushion load signal which indicates the die cushion load.

Comparative Example

Figure 2:
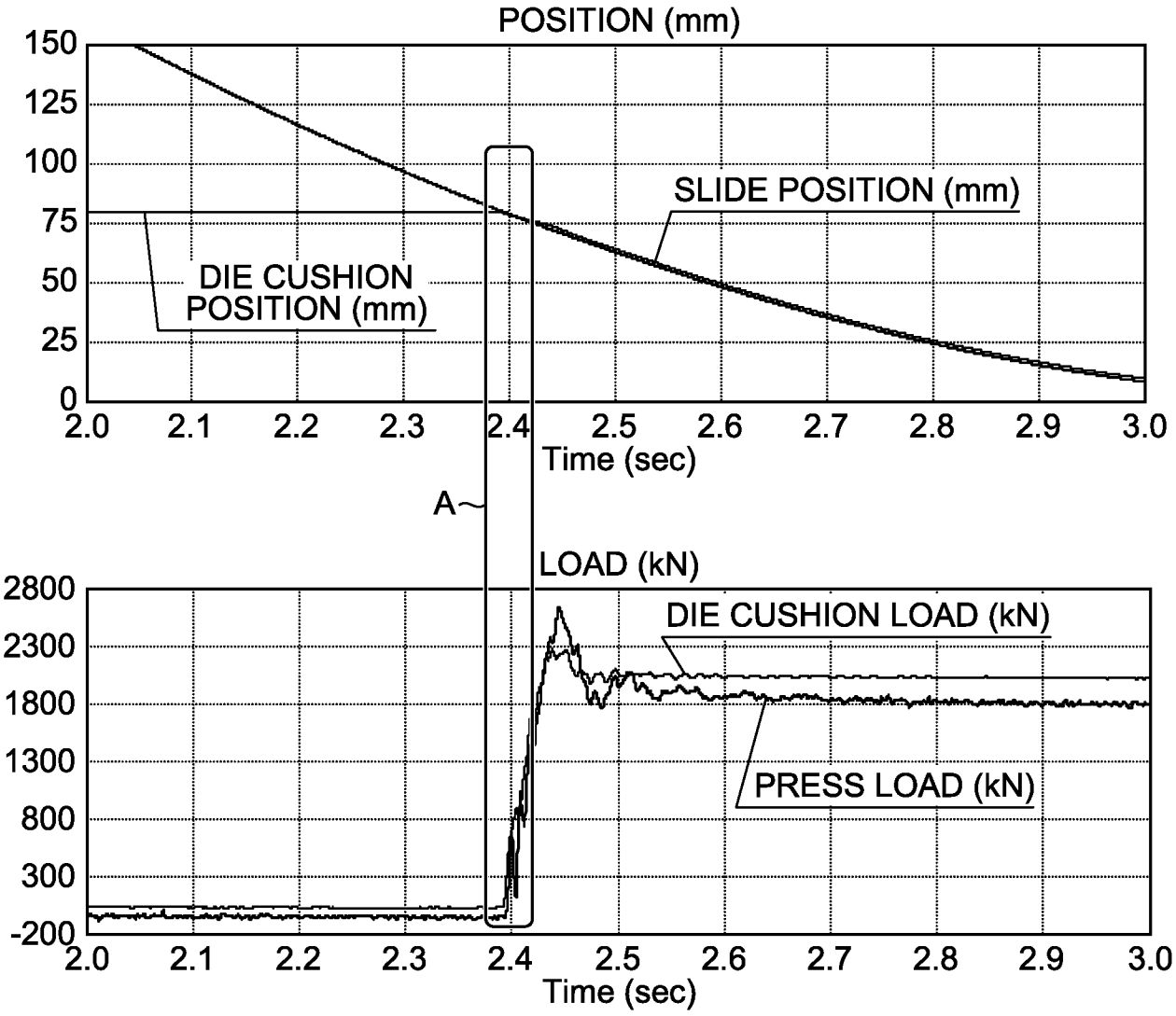
FIG. 2 is waveform diagrams illustrating a die cushion position, a slide position, a die cushion load, and a press load for one second including a range from a starting point to a mid-stage of a process of the die cushion load action in a normal state.

FIG. 2 illustrates waveform diagrams for one second including a period from the start to the middle stage of the process of the die cushion load action in the case where a press machine having a pressing capacity of 10000 kN is used, the die cushion load is set to 2000 kN, and one blank having a plate thickness of 0.8 mm is formed for simulation of a normal state. In FIG. 2, the waveform diagram on the upper side shows the die cushion position (cushion pad position) and the slide position, and a waveform diagram on the lower side shows the die cushion load and the press load.

Figure 3:
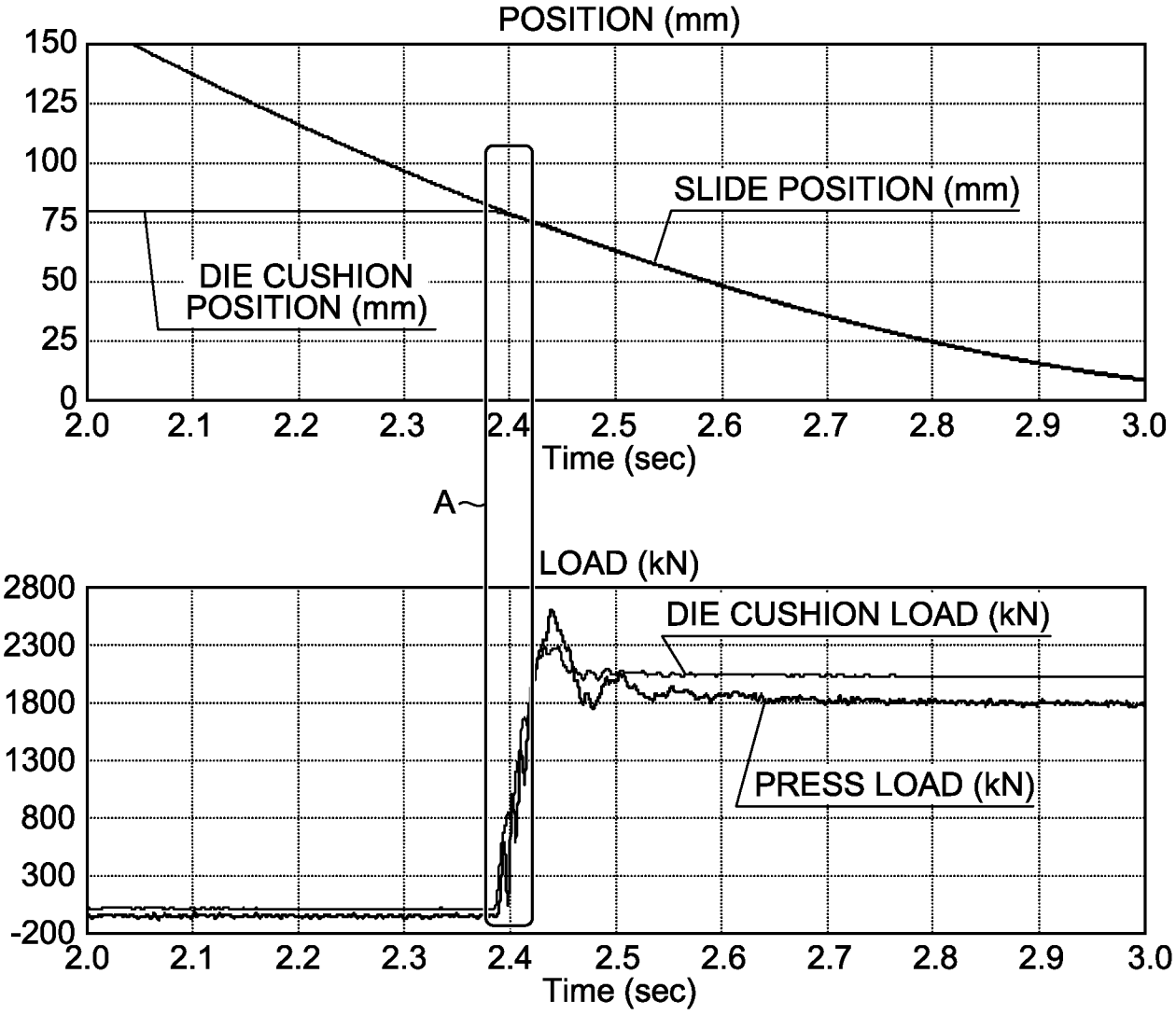
FIG. 3 is waveform diagrams illustrating a die cushion position, a slide position, a die cushion load, and a press load for one second including a range from a start point to a mid-stage of a process of the die cushion load action in an abnormal (double blank) state.

FIG. 3 illustrates waveform diagrams for one second including the period from the start to the middle stage of the process of the die cushion load action in a case where two blanks are formed for simulation of an abnormal (double blank) state, with the same setting as the case of FIG. 2. Similarly to FIG. 2, in FIG. 3, the waveform diagram on the upper side shows the die cushion position and the slide position, and a waveform diagram on the lower side shows the die cushion load and the press load.

The press machine employs a system in which the slide is driven by a servomotor via a link mechanism. The die cushion apparatus employs a system in which the cushion pad is driven by a servomotor via a hydraulic pump/motor and a hydraulic cylinder which are axially connected to the servomotor. For the double-blank detection experiment, the lower die (punch) is removed from the die used in the press machine, and the blank 80 is pressed only between the upper die and the blank holder.

In FIG. 3, the extra pressure corresponding to one blank (thickness 0.8 mm) is applied, compared with FIG. 2.

However, no difference can be found relating to the die cushion load action and the like, and almost the same behavior is observed in both FIG. 2 and FIG. 3 (the data are measured at intervals of 2 ms).

In both FIG. 2 and FIG. 3, the reason why the press load is smaller than the die cushion load in the middle stage of the process of the die cushion load action is a detection error. This is because the detection accuracy of the press load is inferior to the detection accuracy of the die cushion.

Figure 4:
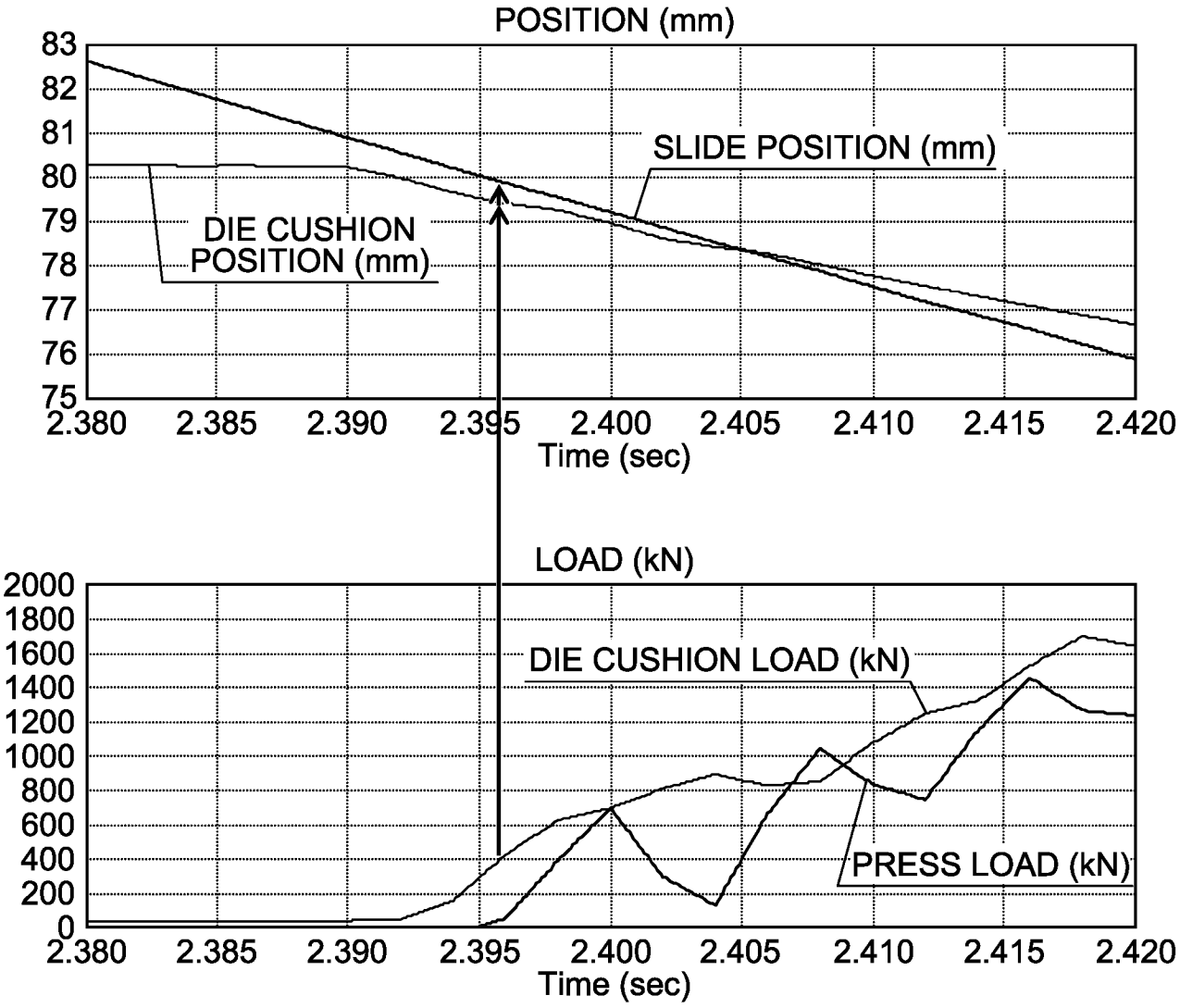
FIG. 4 is enlarged views illustrating a period A (for 0.04 seconds including a timing when the die cushion load starts to act) illustrated in FIG. 2.
Figure 5:
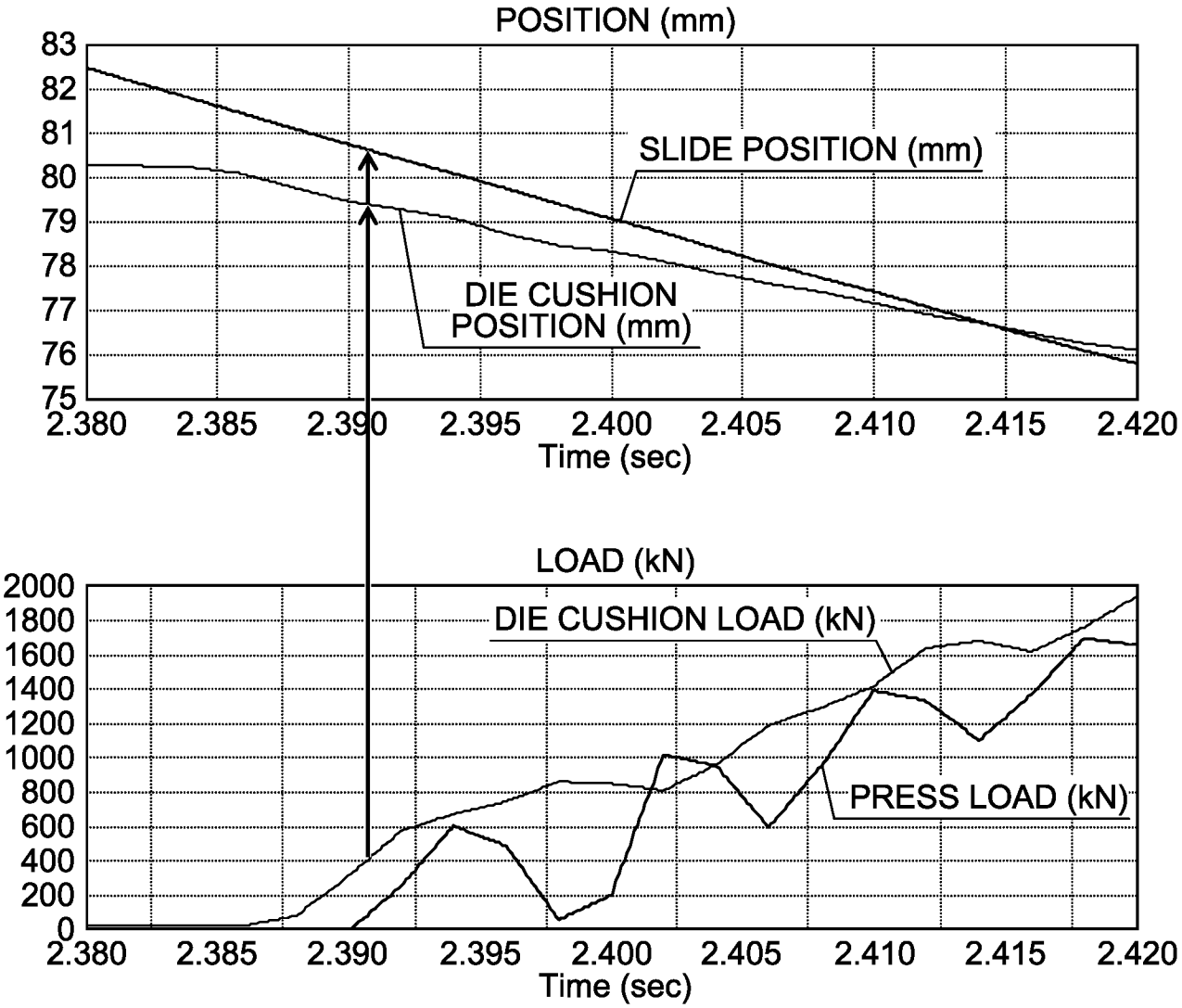
FIG. 5 is enlarged views illustrating the period A (for 0.04 seconds including a timing when an the die cushion load starts to act) illustrated in FIG. 3.

FIG. 4 and FIG. 5 are enlarged views illustrating a period A (for 0.04 seconds including the die cushion load action starting time) illustrated in FIG. 2 and FIG. 3.

FIG. 5 clearly shows the influence of extra pressure caused by one blank (thickness of 0.8 mm), compared with FIG. 4. FIG. 5 shows the characteristic that the die cushion displacement (a distance indirectly pushed down by the slide from the die cushion initial position 80.3 mm) with respect to the die cushion load (degree of action) is substantially constant (identical) in both the normal state (one blank) and the abnormal state (double blank). Further, FIG. 5 shows the characteristic that the slide position with respect to the die cushion load (degree of action) is higher than the normal state shown in FIG. 4 by 0.8 mm corresponding to the thickness of just one blank.

By using (applying) these characteristics, it is possible to detect a double blank at a timing when the die cushion starts to act (initial stage after the start of pressing).

In other words, the slide position in the normal state at a timing when the die cushion load rises to a predetermined value (400 kN in this example) is 79.9 mm (FIG. 4), the slide position in the abnormal state (double blank) is 80.7 mm (FIG. 5). That is, the slide position in the abnormal state is higher than in the normal state by 0.8 mm corresponding to the thickness of one blank.

Therefore, the slide position at a timing when the die cushion load rises to a predetermined value is compared with the abnormality determination value. In a case where the slide position is equal to or more than the abnormality determination value, it is determined that a double blank occurs.

The strongest reason why the double-blank detecting apparatus according to the present invention is suitable is that the die cushion load at the die cushion load starting time is used. The reason is that at the die cushion load action starting time, the die cushion apparatus shows one spring characteristic (inherent elasticity), and the die cushion position (displacement) is substantially proportional to the die cushion load. This characteristic can be observed in any types of die cushion apparatus.

For example, a "so-called" servo die cushion apparatus (or numerical-control die cushion apparatus) drives a servo valve and a servomotor, and controls a die cushion force based on the die cushion load (pressure) command and a die cushion load (pressure). Such a die cushion apparatus may include a hydraulic cylinder driving system by a hydraulic servo valve, a hydraulic cylinder driving system driven by the hydraulic pump/motor axially connected to the servomotor, or a screw nut driving system driven by the servomotor. In the die cushion apparatus, the servo valve and the servomotor are driven based on the die cushion start position command (or die cushion standby position command) and the die cushion position, the cushion pad position is held in the die cushion start position (or die cushion standby position) at the die cushion load starting time (or before the die cushion load action starting time).

In this state, the die cushion load begins to act while the cushion pad is indirectly pushed downward by the slide (via the cushion pin, blank holder, blank, upper die etc.). At the die cushion load starting time, the die cushion load is proportional to X (that is, the result obtained by subtracting "die cushion position" from the "die cushion start position command") indicating the die cushion position displacement, as shown in the following equation.

$$F=K\times X \qquad \text{<Expression 1>}$$

F: Initial die cushion load (kN)

K: spring coefficient (kN/mm) of (inherent to) the die cushion apparatus

X: "Die cushion start position (command)"−"die cushion position" (mm)

Expression 1 shows only the spring coefficient that are static characteristic excluding dynamic characteristics in position (feedback) control. The spring coefficient K corresponds to a constant (gain) proportional to the die cushion position when the die cushion position is (feedback) controlled.

For example, in a die cushion apparatus employing an air cylinder driving system, a die cushion load proportional to the compressed air pressure basically is applied according to a die cushion stroke. However, at the die cushion load starting time, the initial die cushion load proportional to the die cushion initial displacement X is applied, after all.

Figure 6:
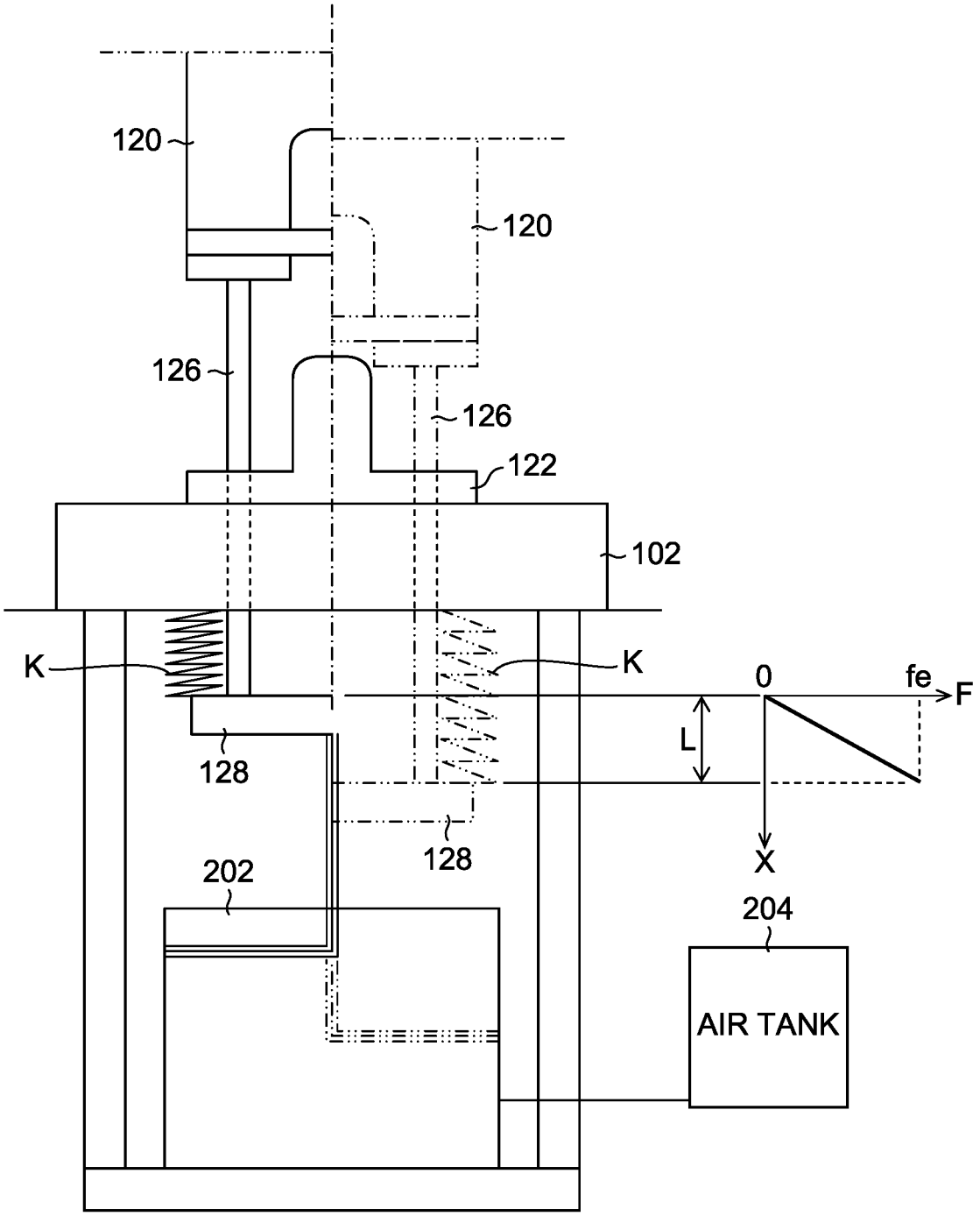
FIG. 6 is a drawing illustrating a principle of the action of an initial die cushion load in a die cushion apparatus of an air cylinder driving system.

FIG. 6 is a view showing an action principle of an initial die cushion load in the die cushion apparatus employing an air cylinder driving system. In FIG. 6, parts or units common to those in FIG. 1 are designated by the same reference numerals, and a detailed description of these common parts or units is omitted.

In FIG. 6, the air cylinder 202 supports the cushion pad 128, and functions as a die cushion driving unit that applies the die cushion load to the cushion pad 128. An air tank 204 capable of adjusting the pressure is connected to the air cylinder 202.

The left side in FIG. 6. illustrates an initial position (0) of the die cushion, and the initial die cushion load (applied to the cushion pins 126) is not acting (F=0) in that state. The right side in FIG. 6 illustrates a state where the die cushion is slightly displaced (by L mm) from the initial position (0). In that state, the die cushion load (F=fo) proportional to the air pressure compressed by the slight displacement L from the initial (before die cushion stroke) air pressure is acting. Here, the difference between the left and right sides in FIG. 6 resulting from the slight displacement L is exaggerated in order to make it easy to understand.

In the state illustrated on the left side in FIG. 6, a frame (bolster 102) bears a thrust of the air cylinder 202, which acts constantly, in association with the action of slight elastic deformation (L mm) of an elastic member (having a spring coefficient K) attached to the frame. In the state illustrated on the right side in FIG. 6, the cushion pins 126 are pressed indirectly by the slide 110, and in turn presses the cushion pad 128 by a slight amount (L mm) downward. As a result, the cushion pins 126 bears the thrust of the air cylinder 202 in association with an action of restoration of the elastic deformation of the elastic member. This (that is, a part of the thrust of the air cylinder 202 acting constantly borne by the cushion pins 126) corresponds to the die cushion load.

After all, the spring coefficient K is inherent to (the type and capacity of) the individual die cushion apparatuses. In other words, the spring coefficient K is the same if the same type of die cushion apparatus is composed of the same mechanical elements and the same control elements.

In contrast, the reason why the method of double-blank detection disclosed in Japanese Patent Laid-Open No. H10-

193199 is not suitable is that the press load signal at a timing when the press load starts to act is used. In other words, by using the press load signal, the disadvantage A (the press load signal becomes complex), the disadvantage B (the press load is susceptible to the eigenfrequency), and the disadvantage C (the resolution of the press load signal is rough) are resulted as described in detail in "Summary of the Invention."

In addition, there is a fourth disadvantage in using the press load signal. The fourth disadvantage is that responsiveness for the die cushion load signal is slow (Disadvantage D).

In general, the press load signal is for monitoring only. In contrast, the die cushion load signal is for controlling the die cushion load. Therefore, the responsiveness of the press load detector is lower than the responsiveness of the die cushion load detector. Due to the lower responsiveness, the press load signal easily fluctuates depending on the die cushion load signal, and thus the accuracy of abnormality (double blank) detection deteriorates.

As illustrated in FIG. 4 and FIG. 5, the press load signal is subjected to the influence of the above-described disadvantages B, C, and D in contrast to the die cushion load signal. Note that, FIG. 2 to FIG. 5 illustrate results of experiment in a state where the lower die (punch) is removed to avoid generation of a forming force, and thus the influence of the disadvantage A does not appear.

Embodiment of the Invention

Figure 7:
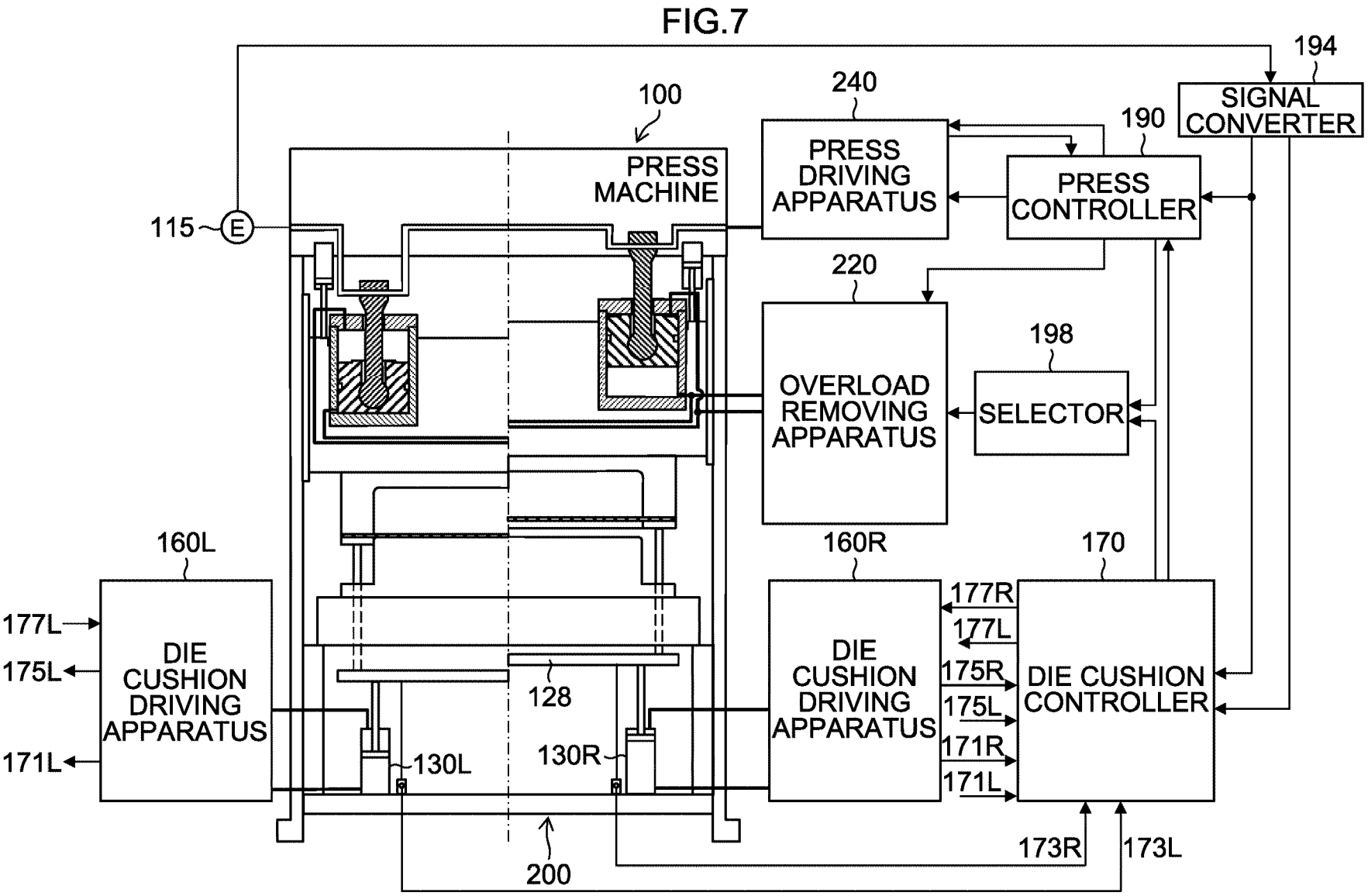
FIG. 7 is a schematic diagram illustrating an embodiment of an entire apparatus including a press machine, a die cushion apparatus, and a die protecting apparatus.

FIG. 7 is a schematic diagram illustrating an embodiment of an entire apparatus including the press machine, the die cushion apparatus, and the die protecting apparatus.

As illustrated in FIG. 7, the entire apparatus includes the press machine 100 and the die cushion apparatus 200. The press machine 100 includes a press controller 190, an overload removing apparatus 220, and a press driving apparatus 240.

The die cushion apparatus 200 includes the cushion pad 128, hydraulic cylinders 130R and 130L, die cushion driving apparatuses 160R and 160L, and a die cushion controller 170.

A die protecting apparatus 300 (FIG. 12) for the press machine according to the present invention in this example is provided in the die cushion controller 170. A double-blank detecting apparatus 302 is provided in the die protecting apparatus 300.

<Mechanical Part of the Press Machine>

Figure 8:
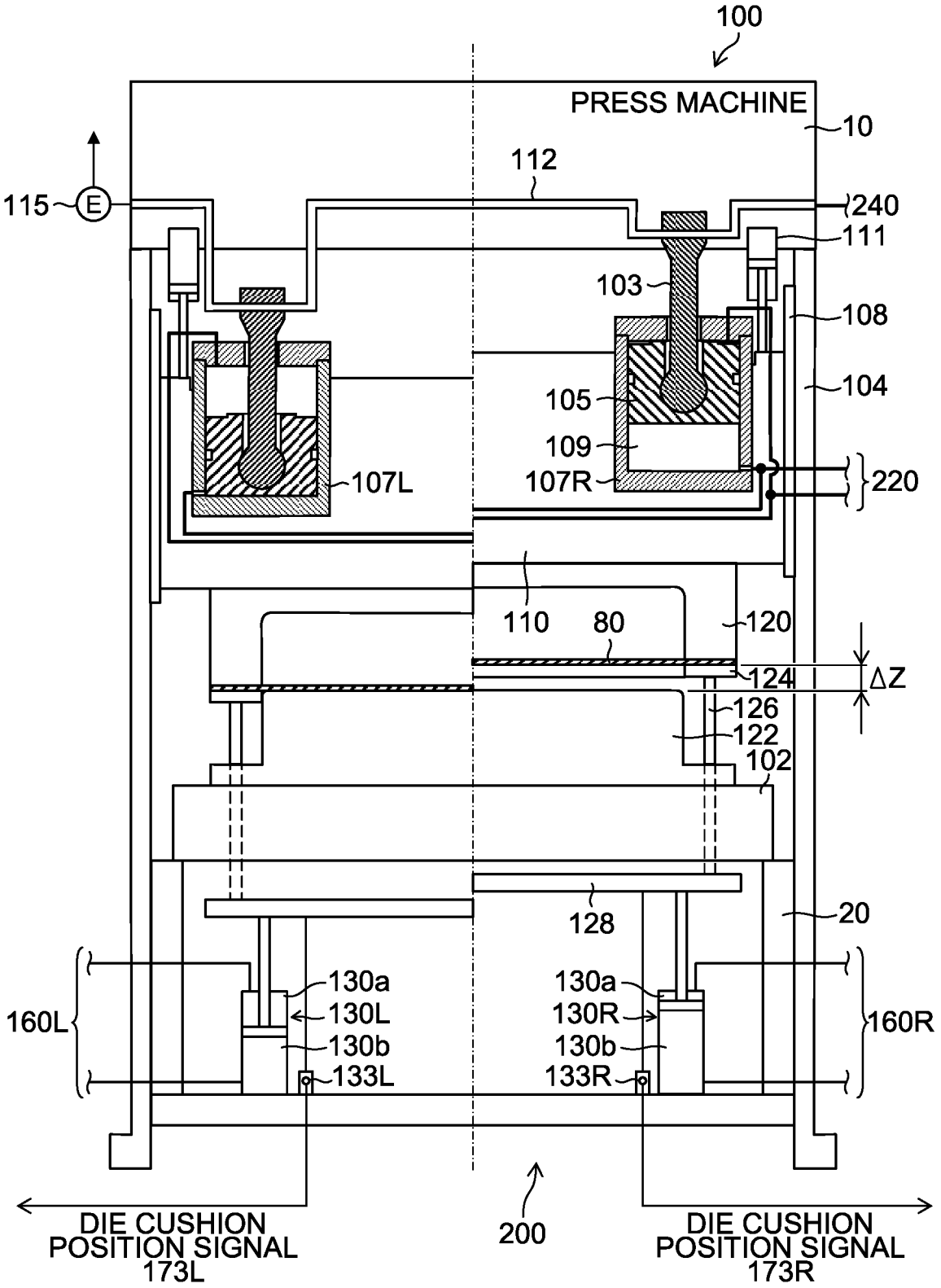
FIG. 8 is a drawing illustrating mechanical parts of the press machine 100 and the die cushion apparatus 200 illustrated in FIG. 7.

FIG. 8 is a drawing illustrating mechanical parts of the press machine 100 and the die cushion apparatus 200 illustrated in FIG. 7.

The press machine 100 illustrated in FIG. 8 includes a frame. The frame includes a crown 10, a bed 20, and a plurality of columns 104 disposed between the crown 10 and the bed 20. The slide 110 is guided by sliding members 108 provided on the columns 104 so as to be movable in the vertical direction.

The press machine 100 is a so-called mechanical servo press in which the slide 110 is driven by a servomotor, which will be described later, via a crankshaft 112 and connecting rods 103. In this example, the press machine 100 is configured to draw a large sized thin plate such as a plate for forming automobile body.

The crankshaft 112 receives a rotary drive force from the press driving apparatus 240. The crankshaft 112 is provided with an encoder 115 which detects an angle and an angular speed of the crankshaft 112.

The slide 110 includes a pair of left and right hydraulic cylinders (fluid pressure-operated cylinders) 107L and 107R integrated (fixed) therein. A distal end of each connecting rod 103 is rotatably fixed to a piston 105 of each of the hydraulic cylinders 107L and 107R.

In FIG. 8, the hydraulic cylinder 107R illustrated on the right side is in a state in which the piston 105 is moved to the upper end, and the hydraulic cylinder 107L illustrated on the left side is in a state in which the piston is moved to the lower end.

In association with the expansion and contraction of each of the hydraulic cylinders 107L and 107R, a relative position between the position of the distal end of the connecting rod 103 and the die mounting surface (lower surface) of the slide 110 varies. In other words, the hydraulic cylinders 107L and 107R are each configured to be able to move the die mounting surface of the slide 110 relatively to the distal ends of the connecting rods 103 by expansion and contraction of the hydraulic cylinders 107L and 107R according to the movement of the slide 110 driven by the crankshaft 112 and the connecting rods 103.

In addition, a pair of balancer cylinders 111 is disposed between the slide 110 and the crown 10. The balancer cylinders 111 are configured to apply an upward force to the slide 110.

The upper die 120 is mounted on the die mounting surface of the slide 110, and the lower die 122 is mounted on the upper surface of the bolster 102 on the bed 20.

<Mechanical Part of Die Cushion Apparatus>

The die cushion apparatus 200 is configured to press from below a peripheral edge of the blank 80 to be formed by the press machine 100, and includes the blank holder (blank holding plate) 124, the cushion pad 128, and the pair of left and right hydraulic cylinders 130L and 130R.

The cushion pad 128 supports the blank holder 124 via the plurality of cushion pins 126.

The hydraulic cylinders 130L and 130R function as a die cushion driving unit that supports the cushion pad 128, moves the cushion pad 128 upward and downward, and causing the cushion pad 128 to generate the die cushion load.

In the vicinity of the hydraulic cylinders 130L and 130R, die cushion position detectors 133L and 133R are provided. The die cushion position detectors 133L and 133R are configured to detect the position of the respective piston rods in the expansion and contraction direction, as the position (the die cushion position) of the cushion pad 128 in the up and down direction.

The blank 80 is set (in contact) on an upper side of the blank holder 124 by a conveying apparatus, which is not illustrated.

When the upper die 120 mounted on the die mounting surface of the slide 110 collides with the cushion pad 128 via the blank 80, the blank holder 124, and the cushion pins 126 in association with the downward movement of the slide 110, the blank 80 is then press-formed between the upper die 120 and the lower die 122 while the peripheral edge of the blank 80 is pressed and held between the upper die 120 and the blank holder 124 to which the die cushion load is applied by the hydraulic cylinders 130L and 130R.

In the die cushion apparatus 200 of this example, the maximum die cushion load is 3000 kN, a set value of the die cushion load (hereinafter referred to as "die cushion load set value") is 2000 kN, and a die cushion stroke is 200 mm. However, 15 mm out of the die cushion stroke 200 mm corresponds to a non-forming stroke $\Delta Z$ ($\Delta Z$=15 mm) which is a range from a moment when the upper die 120 comes into contact with the blank 80 until a moment when the blank 80 comes into contact with the lower die 122. In other words, the standby position of the blank holder 124 is set to a position (Z2) which is larger (higher) than the forming start position (the position Z1 at which the blank 80 comes into contact with the lower die 122), so that press-forming does not start in the range of the stroke before initiation (starting) of forming ΔZ (=Z2−Z1) where the position of the lower surface of the slide is larger (higher) than Z1. Note that the plate thickness of the blank 80 is 0.8 mm in this example.

<Press Driving Apparatus>

Figure 9:
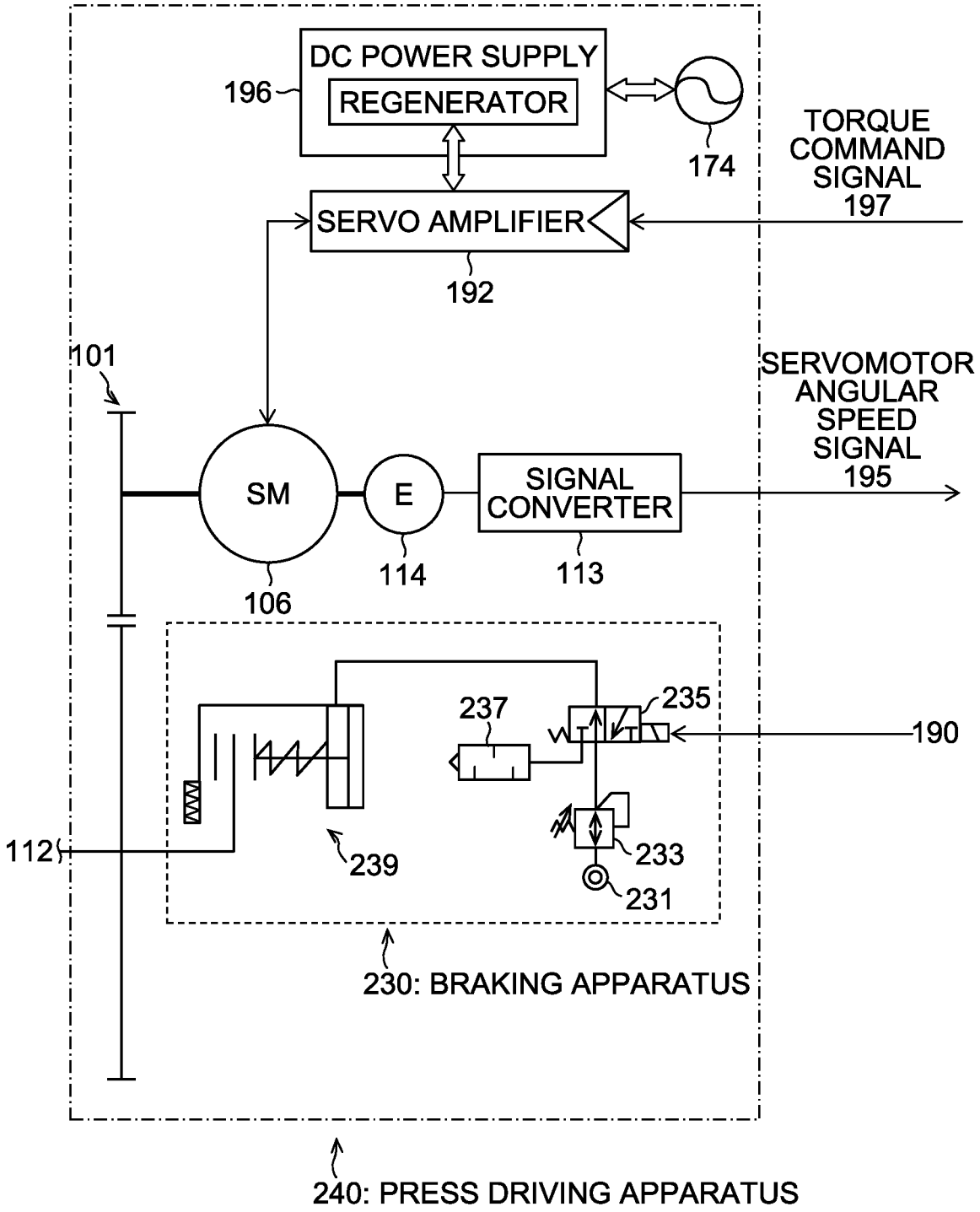
FIG. 9 is a diagram illustrating an example of a press driving apparatus 240 illustrated in FIG. 7.

FIG. 9 is a diagram illustrating an example of the press driving apparatus 240 illustrated in FIG. 7.

The press driving apparatus 240 functions as the driving apparatus and a braking apparatus of the press machine 100 (slide 110). The press driving apparatus 240 includes a servomotor 106, a deceleration gear 101 configured to transmit a rotary drive force of the servomotor 106 to the crankshaft 112, and the braking apparatus 230.

A drive power corresponding to a torque command signal 197 is supplied from a servo amplifier 192 to the servomotor 106. The servomotor 106 is controlled and driven to generate a predetermined (in setting) slide speed or a crank angular speed. Note that a power source is supplied to the servo amplifier 192 from a DC power supply 196 equipped with a regenerator. When brake is applied to the press machine 100 (slide 110), a power generated by a drive torque of the servomotor 106, which acts in the braking direction, is regenerated to the AC power supply 174 via the servo amplifier 192 and the DC power supply 196.

An encoder 114 is attached to a rotary shaft of the servomotor 106, and an encoder signal output from the encoder 114 is converted into a servomotor angular speed signal 195 by a signal converter 113.

The braking apparatus 230 includes a brake-release solenoid valve 235, a brake mechanism 239, and a silencer 237. To brake-release solenoid valve 235, a compression air is supplied from an air pressure source 231 via a decompression valve 233.

A drive signal is applied from the press controller 190 to the brake-release solenoid valve 235, and the brake-release solenoid valve 235 is controlled between ON and OFF.

In the normal state (operating without abnormality), the brake-release solenoid valve 235 of the braking apparatus 230 is turned ON and the brake is released. When (various) abnormalities occur, servo amplifier 192 receives a torque command signal 197 having a direction opposite to the moving direction of the slide in order to brake the slide 110. After the slide 110 stops (substantially simultaneously with the stop), the brake-release solenoid valve 235 is turned OFF to activate the brake.

<Overload Removing Apparatus>

Figure 10:
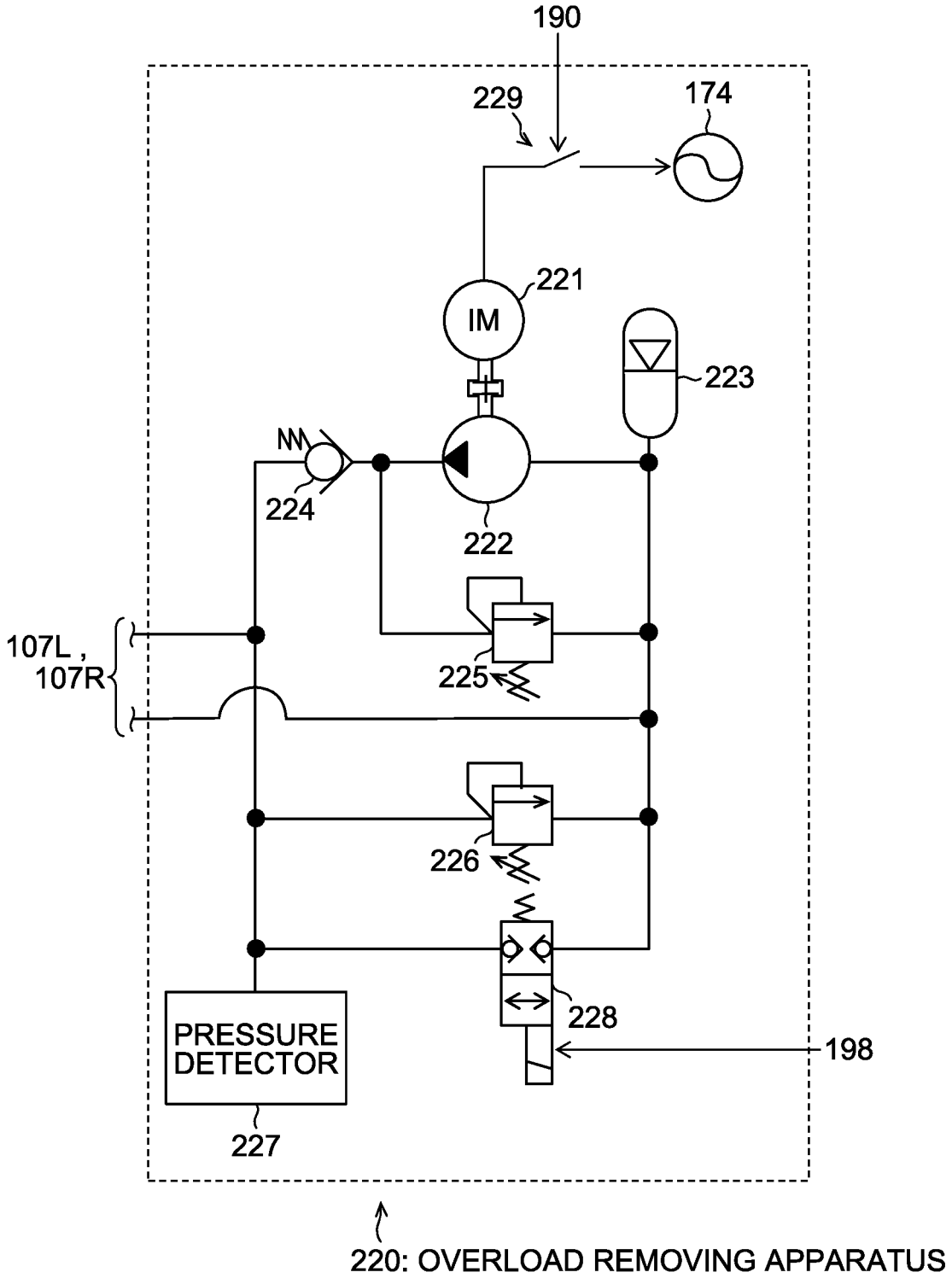
FIG. 10 is a diagram illustrating an example of an overload removing apparatus 220 illustrated in FIG. 7.

FIG. 10 is a diagram illustrating an example of the overload removing apparatus 220 illustrated in FIG. 7.

As illustrated in FIG. 10, the overload removing apparatus 220 includes: an hydraulic pump 222 is axially connected to an induction motor 221; an accumulator 223; a check valve 224 disposed on an discharge port side of the hydraulic pump 222; a relief valves 225 and 226; a pressure detector 227; and a solenoid (depressurizing) valve 228.

A high-pressure line provided with the pressure detector 227. The high-pressure line is connected to a head-side hydraulic chamber 109 of the hydraulic cylinders 107R and 107L which are integrated in the slide 110. A low-pressure line, which is connected to the accumulator 223, is connected to the rod-side hydraulic chamber of the hydraulic cylinders 107R and 107L (FIG. 8).

In the normal state, a pressure of an initial pressure P0 (approximately 200 kg/cm$^2$) is applied to the head-side hydraulic chamber 109. The hydraulic cylinders 107R and 107L maximally extend (the state shown on the right side in FIG. 8) in a no-load state (that is, a load does not act on the slide 110 from outside).

When the head-side hydraulic chamber 109 is pressurized, a contactor 229 is turned ON until the initial pressure P0 is confirmed by the pressure detector 227 in a state in which the slide 110 is at the top dead center (at least in a no-load state). (after P0 is confirmed, the contactor 229 is turned OFF).

A set pressure of the relief valve 225 acting on the discharge port of the hydraulic pump 222 is set to a value slightly larger than the initial pressure P0. Therefore, the initial pressure P0 can be controlled so as to be substantially constant, irrespective of OFF delay time of the contactor 229.

The head-side hydraulic chamber 109 is connected to the accumulator 223, which constitutes a low-pressure line corresponding to a tank function via the relief valve 226 and a solenoid valve 228. When an abnormal cylinder pressure PU (approximately 320 kg/cm$^2$), which corresponds to a case where an abnormal load is applied to the slide 110 (for example, in this example, 22000 kN which corresponds to 110% of a maximum allowable load 20000 kN of the press machine 100) is applied to the head-side hydraulic chamber 109, the relief valve 226 activates. Simultaneously, the pressure detector 227 senses the fact that the abnormal load is applied, turns on the solenoid valve 228, and depressurizes the head-side hydraulic chamber 109.

In this example, the cylinder stroke of the hydraulic cylinders 107R and 107L is 30 mm.

<Die Cushion Driving Apparatus>

Figure 11:
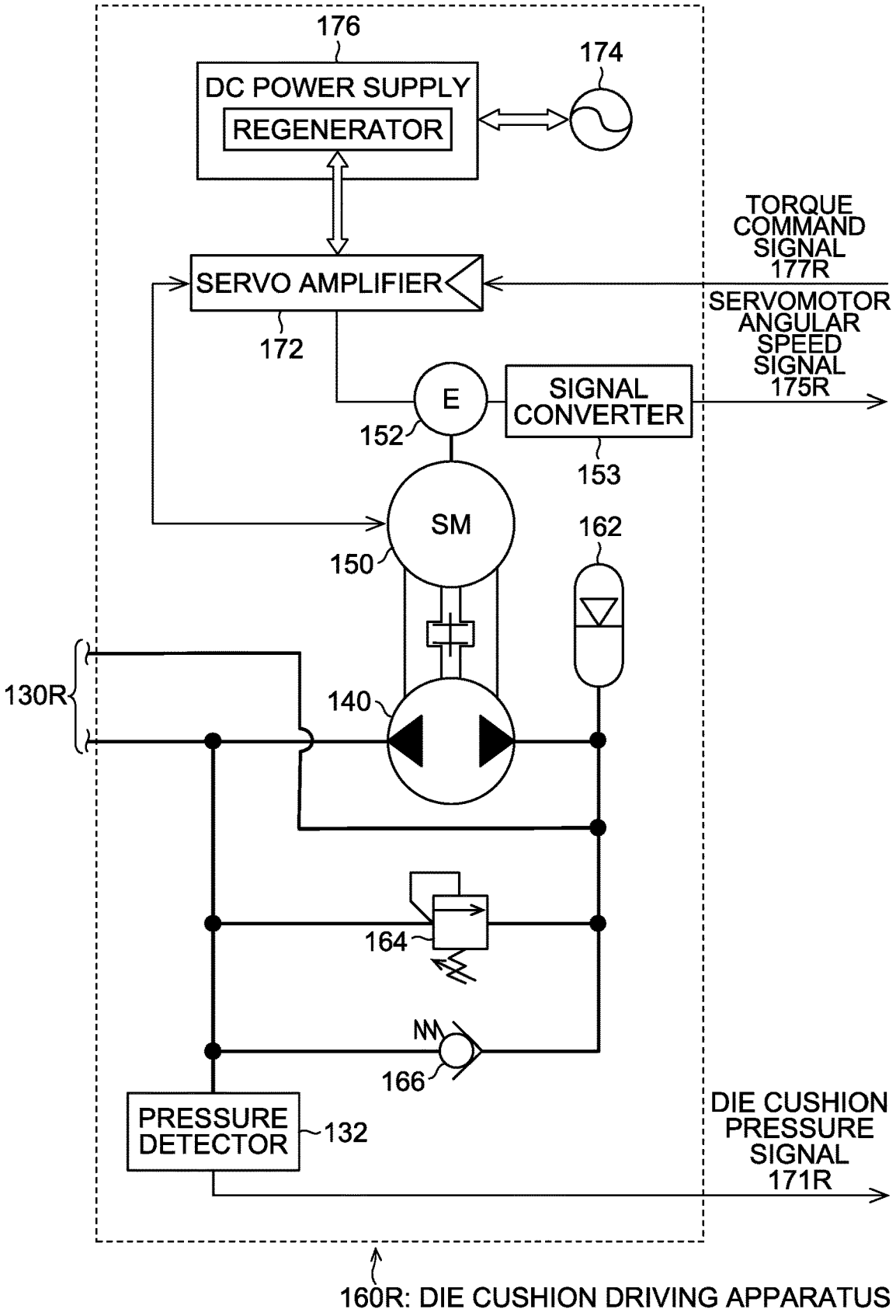
FIG. 11 is a diagram illustrating an example of a die cushion driving apparatus 160R illustrated in FIG. 7.

FIG. 11 is a diagram illustrating an example of a die cushion driving apparatus 160R illustrated in FIG. 7.

A die cushion driving apparatus 160R includes a hydraulic circuit configured to supply hydraulic oil to a rod-side hydraulic chamber 130*a* and a head-side hydraulic chamber 130*b* of the hydraulic cylinder 130R illustrated in FIG. 8. The die cushion driving apparatus 160R includes: an accumulator 162; an hydraulic pump/motor 140; a servomotor 150 connected to a drive shaft of the hydraulic pump/motor 140; an encoder 152 configured to detect an angular speed (servomotor angular speed ω) of a drive shaft of the servomotor 150; a relief valve 164; a check valve 166; and a pressure detector 132 corresponding to the die cushion load detector.

The die cushion driving apparatus 160L configured to supply the hydraulic oil to the hydraulic cylinder 130L has the same configuration as the die cushion driving apparatus 160R. The die cushion driving apparatus 160R will be described.

The accumulator 162 is set to a gas pressure, which is a low pressure, and serves as a tank. In addition, the accumulator 162 supplies a substantially constant low pressure oil to the head-side hydraulic chamber 130*b* of the hydraulic cylinder 130R via the check valve 166 (cushion pressure generating-side pressurizing chamber), and facilitates a pressure increase when the die cushion load is controlled.

One of ports (discharge port) of the hydraulic pump/motor 140 is connected to the head-side hydraulic chamber 130*b* of the hydraulic cylinder 130R, and the other port is connected to the accumulator 162.

The relief valve 164 is activated when an abnormal pressure is generated (when the die cushion load is uncontrollable and an unexpected abnormal pressure is generated).

The relief valve 164 is provided as a device that prevents the hydraulic equipment from being damaged. The rod-side hydraulic chamber 130*a* of the hydraulic cylinder 130R is connected to the accumulator 162.

The pressure detector 132 detects a pressure acting on the head-side hydraulic chamber 130*b* of the hydraulic cylinder 130R and outputs a die cushion pressure signal 171R indicating the detected pressure. The encoder signal output from the encoder 152 mounted on the drive shaft of the servomotor 150 is converted into a servomotor angular speed signal 175R by a signal converter 153.

The die cushion driving apparatus 160R outputs a torque command signal 177R received from the die cushion controller 170, which will be described later, to a servo amplifier 172. The servo amplifier 172 outputs a current amplified based on the torque command signal 177R to the servomotor 150, and drives the hydraulic pump/motor 140. Accordingly, the hydraulic cylinder 130R is driven, and die cushion pressure (load) control and die cushion position control are performed.

The die cushion load (force) can be expressed by a product of the pressure in the head-side hydraulic chamber of the hydraulic cylinder which supports the cushion pad, and a cylinder area. Therefore, controlling the die cushion load is equivalent to controlling the pressure in the head-side hydraulic chamber of the hydraulic cylinder.

The force transmitted from the slide 110 to the hydraulic cylinders 130L and 130R via the cushion pad 128 compresses the head-side hydraulic chambers 130*b* of the hydraulic cylinders 130L and 130R to generate die cushion pressure. Simultaneously, the hydraulic pump/motor 140 functions as the hydraulic motor by the die cushion pressure. Then, when the rotary shaft torque acting on (applied to) the hydraulic pump/motor 140 balances the drive torque of the servomotor 150, the servomotor 150 is rotated so that the pressure rise in the head-side hydraulic chambers 130*b* is suppressed. In the end, the die cushion pressure (die cushion load) is determined according to the drive torque of the servomotor 150.

The die cushion pressure signal 171R output from the pressure detector 132 and the servomotor angular speed signal 175R output from the signal converter 153 are used for generating the torque command signal 177R in the die cushion controller 170.

The torque command signal 177R is output to the servo amplifier 172. A current amplified based on the torque command signal 177R is output to the servomotor 150 from the servo amplifier 172. The drive torque generated in the servomotor 150 drives and rotates the hydraulic pump/motor 140 whose drive shaft is connected to the servomotor 150 so that a pressure to be applied to the head-side hydraulic chamber 130*b* of the hydraulic cylinder 130R is generated. Accordingly, the die cushion load generated from the hydraulic cylinder 130R is controlled.

Note that a power source is supplied to the servo amplifier 172 from a DC power supply 176 equipped with a regenerator. When the die cushion load (pressure) is controlled, a power is generated by the servomotor 150 driven by a drive force from the hydraulic pump/motor 140 which acts as the hydraulic motor, and the generated power is regenerated to the AC power supply 174 via the servo amplifier 172 and the DC power supply 176.

<Press Controller and Die Cushion Controller>

Figure 12:
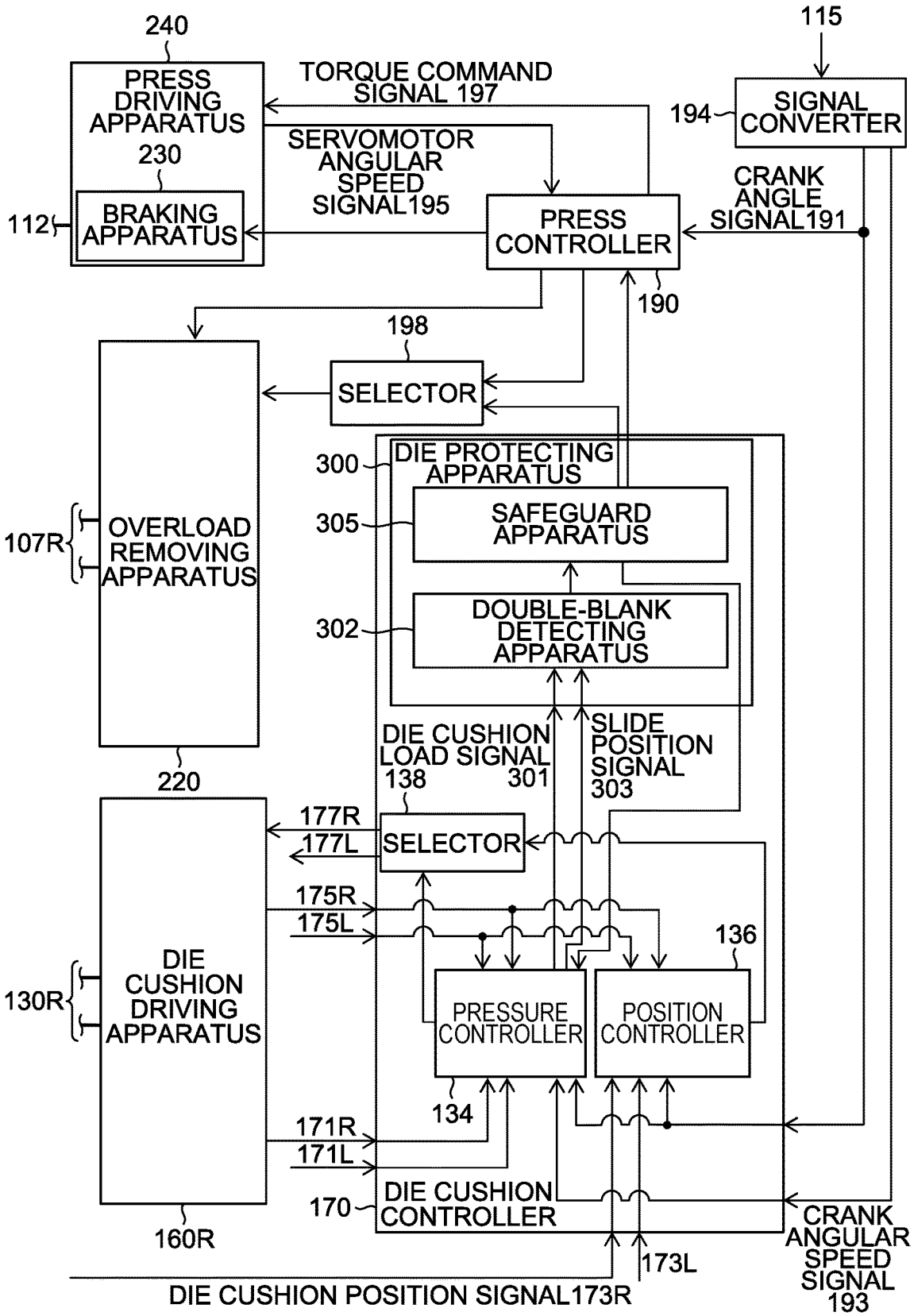
FIG. 12 is a diagram mainly illustrating an embodiment of a die cushion controller 170 illustrated in FIG. 7.

FIG. 12 is a diagram mainly illustrating an embodiment of a die cushion controller 170 illustrated in FIG. 7.

The die cushion controller 170 illustrated in FIG. 12 includes the pressure controller (die cushion load controller) 134 and the position controller (die cushion position controller) 136, and in addition, the die protecting apparatus 300 according to the present invention.

The pressure controller 134 receives the die cushion pressure signals 171R and 171L, the servomotor angular speed signals 175R and 175L, a crank angle signal 191, a crank angular speed signal 193, and a die cushion load switching command (switching command that makes the die cushion load with the maximum capacity to act when a double blank is detected) from a safeguard apparatus 305 which will be described later. Note that the crank angle signal 191 and the crank angular speed signal 193 are signals indicating the angle and the angular speed of the crankshaft 112. The crank angle signal 191 and the crank angular speed signal 193 are signals converted by a signal converter 194 which receives an encoder signal output from the encoder 115 mounted on the crankshaft 112.

The pressure controller 134 includes a die cushion pressure command unit (die cushion load command unit) configured to output a preset die cushion pressure (load) command, and receives the die cushion pressure signals 171R and 171L in order to control the die cushion pressure in conformance with the die cushion pressure command.

In addition, the pressure controller 134 receives servomotor angular speed signals 175R and 175L as an angular speed feedback signal mainly for controlling the die cushion pressure (load) and ensuring dynamic stability in position control. In addition, the pressure controller 134 also receives the crank angular speed signal 193 indicating the crank angular speed. The crank angular speed signal 193 is used for compensation in order to secure accuracy in pressure control during the die cushion pressure (load) control.

In addition, in order to obtain a timing to start a die cushion function, the pressure controller 134 includes a signal converter configured to covert the entered crank angle signal 191 into a slide position signal 303 which indicates the position of the slide 110. The pressure controller 134 starts or ends the die cushion pressure (load) control based on the slide position signal 303 converted by the signal converter. The die cushion (load) command unit in the pressure controller 134 outputs a corresponding die cushion pressure (load) command based on the slide position signal 303.

When controlling the die cushion pressure (load), the pressure controller 134 calculates the torque command signals 177R and 177L using the received die cushion pressure command, the die cushion pressure signals 171R and 171L, the servomotor angular speed signals 175R and 175L, and the crank angular speed signal 193, and then, outputs the torque command signals 177R and 177L to the die cushion driving apparatuses 160R and 160L via a selector 138.

In addition, the pressure controller 134 receives from the safeguard apparatus 305 the die cushion load switching command for automatically switching the die cushion load when a double blank is detected. In this case, the pressure controller 134 outputs the torque command signals 177R and 177L which correspond to the maximum pressurizing capacity (in this example, a command for applying a die cushion load of 3000 kN which is typical in an application for forming automobile bodies).

On the other hand, the position controller 136 receives the die cushion position signals 173R and 173L, the servomotor angular speed signals 175R and 175L, and the crank angle signal 191.

The position controller 136 includes the die cushion position command unit, and controls the hydraulic cylinders 130L and 130R based on the die cushion position command output from the die cushion position command unit after the end of control of the die cushion pressure (load) by the pressure controller 134. The die cushion position command unit receives the die cushion position signals 173R and 173L in order to use for initial value generation in generating the die cushion position command. After the slide 110 (cushion pad 128) reaches the bottom dead center and the control of the die cushion pressure (load) ends, the die cushion position command unit performs a product knockout action. The die cushion position command unit also outputs a position command (die cushion position command) for controlling the die cushion position (position of the cushion pad 128) in order to make the cushion pad 128 standby at a predetermined die cushion standby position which is the initial position. The position command is commonly used for the product knockout action and for the standby at the die cushion standby position.

Under the die cushion position control, the position controller 136 generates the torque command signals 177R and 177L based on the common die cushion position command output from the die cushion position command unit and the die cushion position signals 173R and 173L detected respectively by the die cushion position detectors 133L and 133R. Then, the position controller 136 outputs the generated torque command signals 177R and 177L to the selector 138. Note that it is preferable that the position controller 136 receives the servomotor angular speed signals 175R and 175L, and performs the position control of the cushion pad 128 in the up-down direction based on the servomotor angular speed signals 175R and 175L, in order to ensure the dynamic stability in position control. Furthermore, it is preferable that the position controller 136 performs position control to prevent indirect collision of the cushion pad 128 with the slide 110 at the time of knockout based on the crank angle signal 191 which is input to the position controller 136.

Under the control of the die cushion pressure (load) in response to the selection command input from the pressure controller 134, the selector 138 selects the torque command signals 177R and 177L input from the pressure controller 134, outputs the selected signal to the die cushion driving apparatuses 160R and 160L. Under the control of the die cushion position, the selector 138 selects the torque command signals 177R and 177L input from the position controller 136 and outputs the selected signal to the die cushion driving apparatuses 160R and 160L.

The die cushion controller 170 outputs the torque command signals 177R and 177L generated as described above to the die cushion driving apparatuses 160R and 160L, drives the servomotor 150 via the servo amplifier 172 in the die cushion driving apparatuses 160R and 160L, and performs the die cushion pressure (load) control and the die cushion position control.

The press controller 190 receives the crank angle signal 191 and the servomotor angular speed signal 195. The press controller 190 generates a torque command signal 197 based on the received crank angle signal 191 and servomotor angular speed signal 195 in order to achieve a predetermined slide speed or crank angular speed. Then, the press controller 190 outputs the generated torque command signal 197 to the press driving apparatus 240 (servo amplifier 192). The servomotor angular speed signal 195 is used as an angular speed feedback signal for securing dynamic stability of the slide 110.

The press controller 190 also generates a torque command signal 197 based on a brake command received from the die protecting apparatus 300 in order to apply a maximum torque in the braking direction to the press driving apparatus 240. In addition, the press controller 190 outputs a signal to turn the braking apparatus 230 (brake-release solenoid valve 235) ON and OFF.

<Die Protecting Apparatus>

As illustrated in FIG. 12, the die cushion controller 170 of this example includes the die protecting apparatus 300.

The die protecting apparatus 300 is provided in the die cushion controller 170 for the convenience of application of the die cushion load signal 301 and the slide position signal 303. The die protecting apparatus 300 has a mission to identify abnormality quickly and cope with the abnormality. Thus, the die protecting apparatus 300 is required to achieve a faster processing time. Compared to providing the die protecting apparatus 300 in the press controller 190 which performs angle control (position control) of the slide (crankshaft), it is more effective to provide the die protecting apparatus 300 in the die cushion controller 170 which performs control of the die cushion load (die cushion pressure) (power control) because the operating cycle of the controller is generally faster (faster operating cycle is required). In addition, compared to the case of providing the die protecting apparatus separately, it is more effective because waste of time in association with input and output processing of both signals can be omitted.

The die protecting apparatus 300 includes the double-blank detecting apparatus 302 and the safeguard apparatus 305.

<Double-Blank Detecting Apparatus 302>

Figure 13:
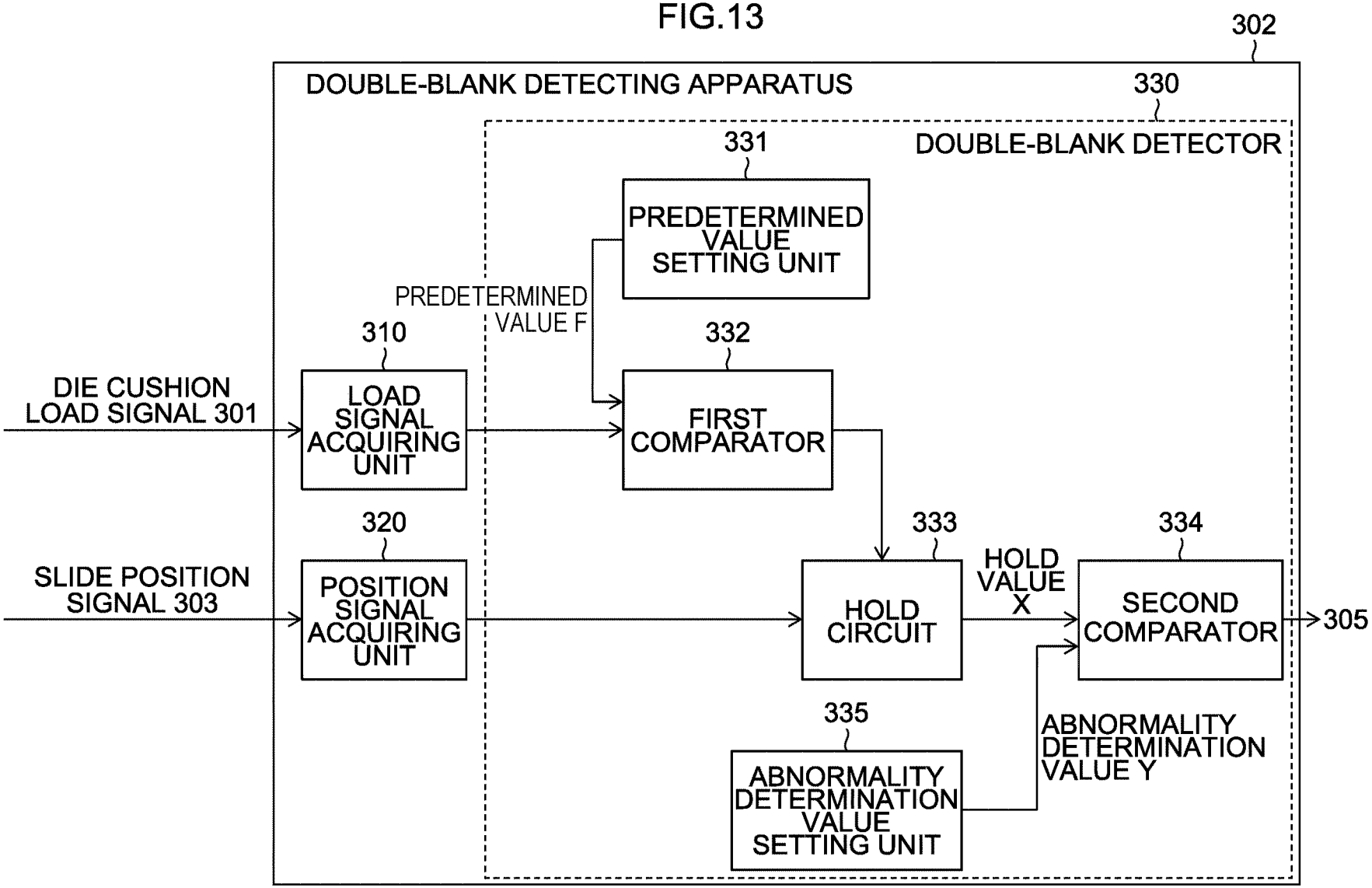
FIG. 13 is a block diagram illustrating an embodiment of a double-blank detecting apparatus 302.

FIG. 13 is a block diagram illustrating an embodiment of the double-blank detecting apparatus 302.

As illustrated in FIG. 13, the double-blank detecting apparatus 302 includes: a load signal acquiring unit 310; a position signal acquiring unit 320; and a double-blank detector 330. The double-blank detector 330 further includes: a predetermined value setting unit 331; a first comparator 332; a hold circuit 333; a second comparator 334; and an abnormality determination value setting unit 335.

The load signal acquiring unit 310 is configured to acquire the die cushion load signal 301 which indicates a die cushion load generated on the cushion pad 128 of the die cushion apparatus 200. The pressure controller 134 of the die cushion controller 170 calculates the die cushion load signal 301 which indicates the die cushion load based on the die cushion pressure signals 171R and 171L. Then, the pressure controller 134 outputs the die cushion load signal 301 to the load signal acquiring unit 310. The load signal acquiring unit 310 may be configured to receive the die cushion pressure signals 171R and 171L directly, and acquire the die cushion load signal 301 which indicates the die cushion load calculated based on these die cushion pressure signals 171R and 171L.

The position signal acquiring unit 320 is configured to acquire the slide position signal 303 which indicates the position of the slide 110 of the press machine 100. The position signal acquiring unit 320 receives the slide position signal 303 (which is converted from the crank angle signal 191 by the signal converter in the pressure controller 134) from the pressure controller 134 of the die cushion controller 170.

Note that in this example, the encoder 115 provided on the crankshaft 112, the signal converter 194 (FIG. 7), and the signal converter in the pressure controller 134 function as the slide position detectors. However, the configuration is not limited thereto. A slide position detector configured to detect the position of the slide 110 may be provided between the bed 20 (or the bolster 102) and the slide 110 of the press machine 100.

The die cushion load signal 301 acquired by the load signal acquiring unit 310 is output to the first comparator 332. As another input, the first comparator 332 receives a predetermined value F from the predetermined value setting unit 331. The first comparator 332 compares these two inputs. When the die cushion load signal 301 reaches the predetermined value F, the first comparator 332 outputs a signal which enables the hold circuit 333 to perform a holding action.

Here, it is preferable that the predetermined value F set by the predetermined value setting unit 331 is within a range from 5% to 20% inclusive (5% or more and 20% or less) of the maximum die cushion load of the die cushion apparatus 200. In this example, the maximum die cushion load is 3000 kN, and the predetermined value F is set to F=200 kN (the value corresponding to approximately 7% of the maximum die cushion load 3000 kN). The predetermined value F is set manually by a manual setting unit (second manual setting unit). Or, the predetermined value F may be set by automatically calculating the predetermined value F based on the maximum die cushion load of the die cushion apparatus with the automatic setting unit (second automatic setting unit).

The slide position signal 303 acquired by the position signal acquiring unit 320 is output to the hold circuit 333.

The hold circuit 333 holds the slide position signal 303 at a timing when the die cushion load signal 301 rises to the predetermined value (F) for each cycle (at a timing when a signal is input from the first comparator 332) in association with the start of the die cushion load action.

The slide position signal hold value X (that is, the hold value X of the slide position signal) held by the hold circuit 333 is output to the second comparator 334. As another input, the second comparator 334 receives an abnormality determination value Y from the abnormality determination value setting unit 335. The second comparator 334 compares the slide position signal hold value X and the abnormality determination value Y, and detects a case where the slide position signal hold value X is equal to or larger than the abnormality determination value Y as a state in which two (a plurality of) blanks 80 are stacked (double blank).

Figure 14:
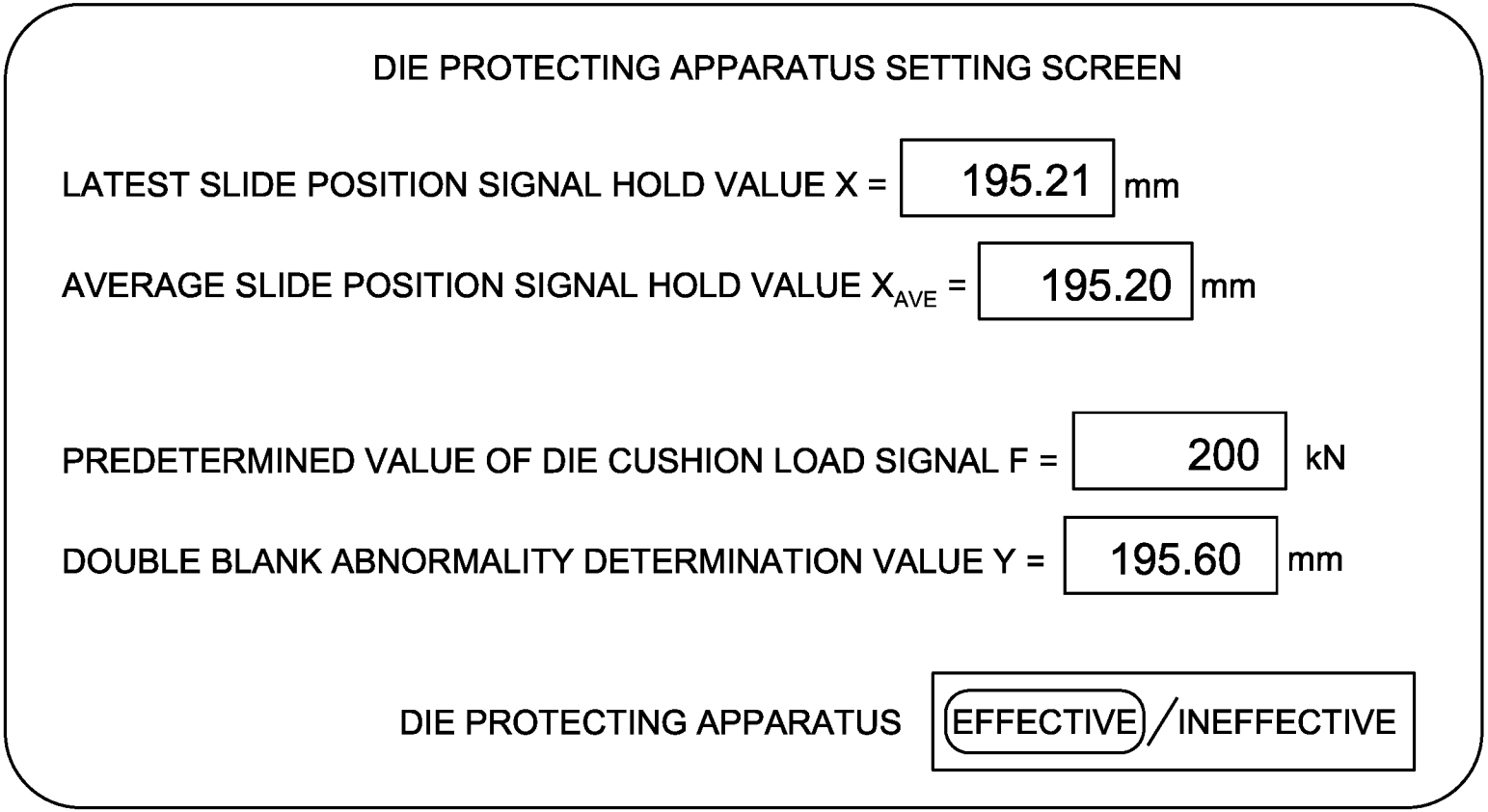
FIG. 14 is a drawing illustrating an example of a setting screen for the die protecting apparatus.

FIG. 14 is a drawing illustrating an example of a setting screen for setting the die protecting apparatus.

The setting screen for the die protecting apparatus displays the slide position signal hold value X for each forming (conditions specific for forming such as a die, a blank, a die cushion load set value, a speed setting of the press machine, a die height setting, and the like), an average value $X_{AVE}$ of the slide position signal hold value X repeated normally (when forming one blank) by a plurality of times, the predetermined value F of the die cushion load signal when holding the slide position signal hold value X, and the abnormality determination value (double blank abnormality determination value) Y.

In this example, the latest slide position signal hold value is X=195.21 mm, and the average value is $X_{AVE}$=195.20 mm. The latest value is a value in the newest (last) cycle in productions performed in the past, and is held until right before the timing when the next action of the die cushion load starts. The average value $X_{AVE}$ is an average value of a plurality of times (100 times in this example) performed normally (without any abnormality) in the past.

The predetermined value F of the die cushion load signal is F=200 kN in this example, and the abnormality determination value Y which corresponds to the threshold value of the double-blank detection in this embodiment is Y=195.60 mm. These values are constantly displayed on the die protecting apparatus setting screen of the die cushion operating equipment (FIG. 14).

The abnormality determination value Y set by the abnormality determination value setting unit 335 is set as a value obtained by adding half the plate thickness (0.8 mm) to the average value $X_{AVE}$=195.20 mm of the slide position signal hold value X ($Y=X_{AVE}+0.5T=195.20+0.5\times0.8=195.60$, where T is the plate thickness).

The abnormality determination value Y may be set manually with the manual setting unit (first manual setting unit). Or, the abnormality determination value Y may be set with the automatic setting unit (first automatic setting unit) by automatically calculating the abnormality determination value Y based on the average value $X_{AVE}$ of the slide position signal hold value X and the plate thickness T.

The abnormality determination value Y set by the abnormality determination value setting unit 335 is not limited to 195.60 mm described above, and may be set to a value that satisfies the following condition;

$$Y \geq (X_{AVE}+0.3T) \text{ and } Y<(X_{AVE}+T) \quad \text{<Expression 2>}$$

where $X_{AVE}$ is the average value of the slide position signal hold value X obtained by repeating a plurality of times of forming of one blank, and T is the plate thickness of the blank 80.

The second comparator 334, which functions as the double-blank detector, detects the case where the slide position signal hold value X is equal to or larger than the abnormality determination value Y set within a range of the above-described Expression 2 as a double blank.

In this example, the abnormality determination value Y is set based on the average value $X_{AVE}$ of the slide position signal hold value X as shown by Expression 2. However, the present invention is not limited thereto. The abnormality determination value Y may be set based on the slide position signal hold value obtained when forming of two stacked blanks is tested.

In other words, the abnormality determination value Y may be set to a value that satisfies the following condition, $$Y<X' \text{ and } Y \geq (X'-0.7T) \quad \text{<Expression 3>}$$

where X' is the slide position signal hold value obtained when forming of two stacked blanks is tested, and T is the plate thickness of the blank 80.

The slide position signal hold value X,' which can be obtained when forming of two stacked blanks is tested, is larger than the average value $X_{AVE}$ of the slide position signal hold value X by an amount corresponding to the plate thickness of one blank. Therefore, Expression 2 and Expression 3 indicate substantially equivalent range.

The second comparator 334 detects the double blank when the slide position signal hold value X is equal to or larger than the abnormality determination value Y set according to the above-described expression Expression 2 or expression Expression 3, and outputs to the safeguard apparatus 305, a command for applying sudden braking to the slide 110. In addition, the second comparator 334 can notify "Double Blank Detected" on the die protecting apparatus setting screen of the die cushion operating equipment.

<Safeguard Apparatus>

When the double blank is detected by the double-blank detecting apparatus 302, the safeguard apparatus 305 illustrated in FIG. 12 outputs to the press controller 190 the command for applying sudden braking to the slide 110.

In response to this command, the press controller 190 outputs the torque command signal 197 in a direction opposite to the direction of the slide's movement to the press driving apparatus 240, and makes the slide 110 start sudden braking. After the slide 110 stops (substantially at the same time as stop), the press controller 190 turns OFF the brake-release solenoid valve 235 of the braking apparatus 230 for activating the brake.

When the double-blank detecting apparatus 302 detects a double blank, the safeguard apparatus 305 outputs a command for depressurizing the head-side hydraulic chamber 109 of the hydraulic cylinders 107R and 107L integrated in the slide 110 to the overload removing apparatus 220 via a selector 198, simultaneously with the command for applying the sudden braking to the slide 110.

In response to this command, the overload removing apparatus 220 (FIG. 10) turns ON the solenoid (depressurizing) valve 228, connects the head-side hydraulic chambers 109 of the hydraulic cylinders 107R and 107L to the accumulator 223 having a low pressure via the solenoid (depressurizing) valve 228, and depressurizes the head-side hydraulic chambers 109.

Further, when a double blank is detected by the double-blank detecting apparatus 302, the safeguard apparatus 305 outputs to the pressure controller 134, a command for causing the cushion pad 128 to apply a predetermined die cushion load (the maximum capacity of 3000 kN in this example) in order to rapidly contract the head-side hydraulic chambers 109 of the depressurized hydraulic cylinders 107R and 107L.

In response to this command, the pressure controller 134 outputs the torque command signals 177R and 177L for making the maximum capacity 3000 kN act on the cushion pad 128.

<Double-Blank Detection and Act of Safeguard Apparatus>

Figure 15:
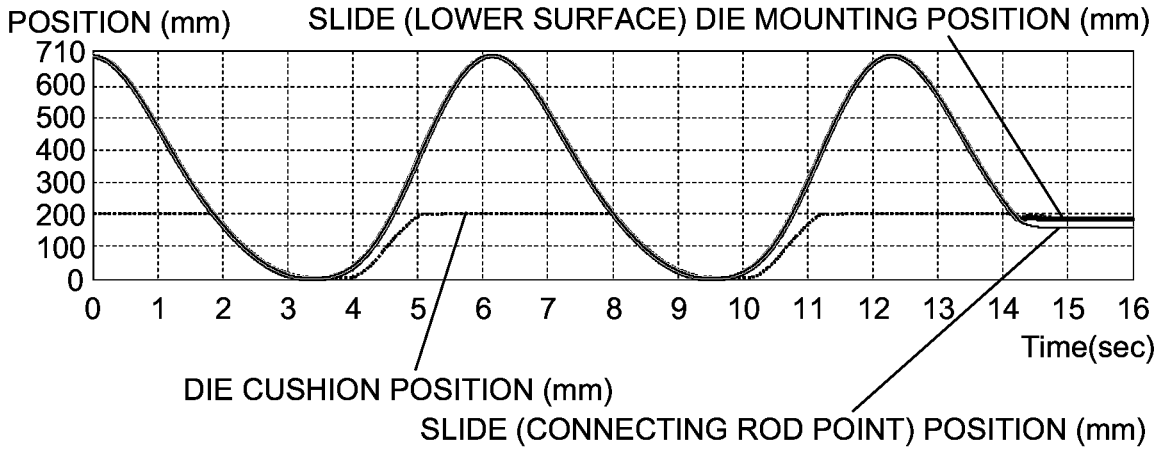
FIG. 15 is a waveform diagram illustrating a slide position and a die cushion position.
Figure 16:
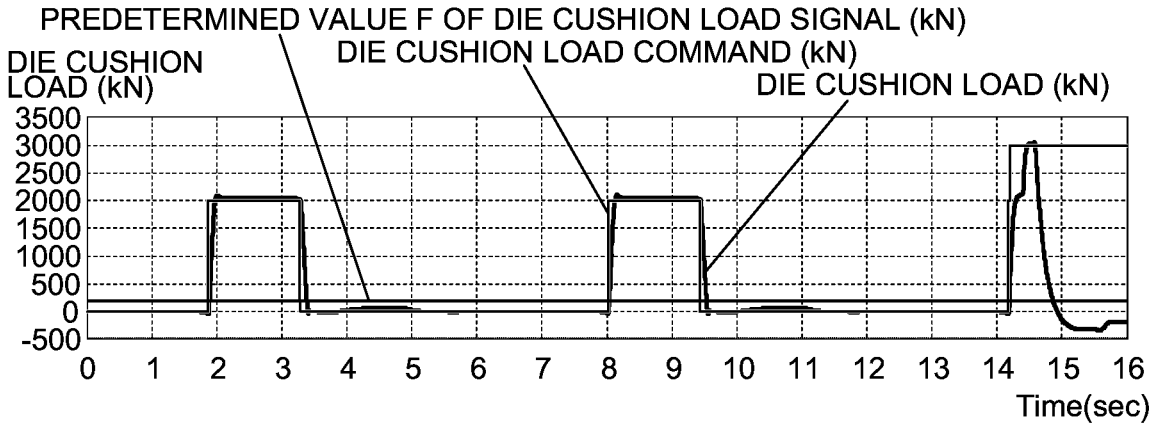
FIG. 16 is a waveform diagram illustrating a predetermined value of a die cushion load signal, a die cushion load command, and a die cushion load.

FIG. 15 is a waveform diagram illustrating the slide position and the die cushion position, and FIG. 16 is a waveform diagram illustrating a predetermined value F of the die cushion load signal, the die cushion load command, and the die cushion load.

Figure 17:
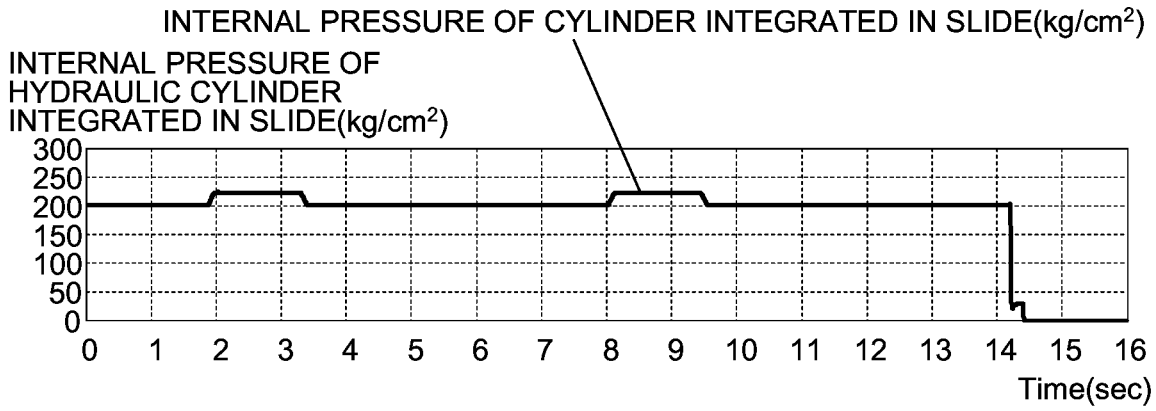
FIG. 17 is a waveform diagram illustrating a pressure in a head-side hydraulic chamber of hydraulic cylinders 107R and 107L integrated in the slide.
Figure 18:
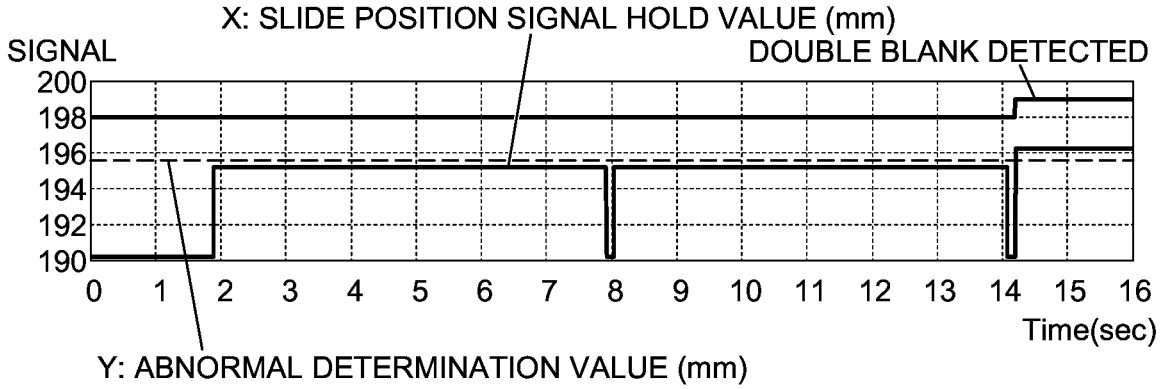
FIG. 18 is a waveform diagram illustrating slide position signal hold value X, an abnormality determination value Y, and double-blank detection.

The FIG. 17 illustrates a pressure in the head-side hydraulic chambers of the hydraulic cylinders 107R and 107L integrated in the slide, and FIG. 18 is a waveform diagram illustrating the slide position signal hold value X, the abnormality determination value Y, and detection of a double blank.

FIG. 15 to FIG. 18 each illustrate a waveform for three cycles, and normal function is observed in the first cycle and the second cycle. During the process of the die cushion load control, the die cushion load is more or less 2050 kN which is slightly excessive with respect to the value of 2000 kN which is instructed by the command when the die cushion load control is started (FIG. 16).

The pressure in the head-side hydraulic chambers of the hydraulic cylinders 107R and 107L is increased in accordance with the press load value during forming (when the die cushion load acts) with respect to the initial pressure of 200 kg/cm$^2$ (FIG. 17).

The slide position signal hold value X transitions from 195.23 mm in the first cycle to 195.13 mm in the second cycle (FIG. 18). These values are held at a timing when the die cushion load signal raises to the predetermined value F (F=200 kN in this example), and are released when the slide position is at a position of 210 mm which is 10 mm above the slide position 200 mm corresponding to the next die cushion standby position.

In the third cycle, a double blank is detected. The slide position signal hold value X here is 196.2 mm which exceeds the double blank abnormality determination value Y (=195.60 mm). Therefore, the double blank is detected by the double-blank detecting apparatus 302 (FIG. 18).

A timing when the blank holder 124 and the upper die 120 come into contact with each other via (two) blanks immediately before the double-blank detection (at a time point immediately before starting the control of the die cushion load) is illustrated in the right half of the press machine in FIG. 8. In this state, the non-forming stroke ΔZ between a lower surface of the blank 80 and the lower die 122 (punch) is 15 mm (ΔZ=15 m), and thus forming does not start until the slide 110 (lower surface) moves 15 mm further downward.

FIG. 19 to FIG. 22 each illustrate parts of cycle waveforms in FIG. 15 to FIG. 18 in an enlarged scale showing mainly the timing when a double blank is detected.

Figure 19:
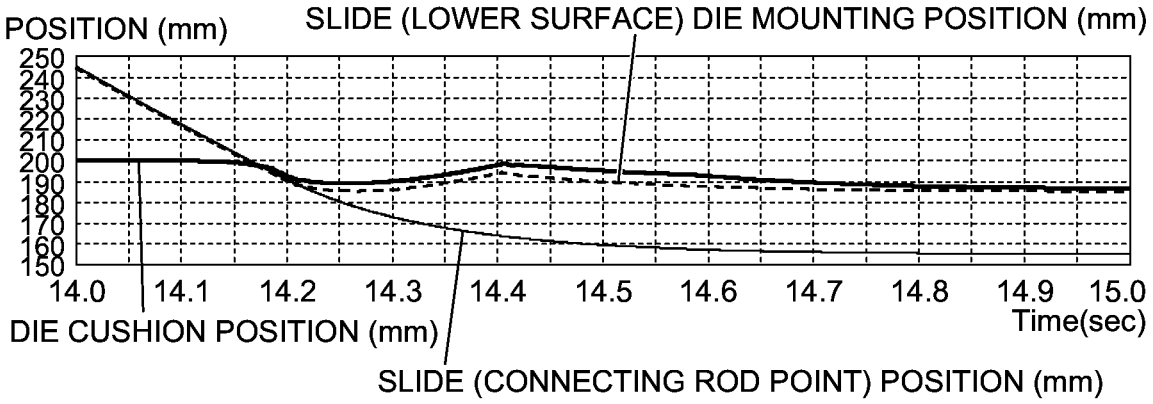
FIG. 19 is a partial enlarged view of the waveform diagram illustrated in FIG. 15 showing mainly the timing when a double blank is detected.

When a double blank is detected by the double-blank detecting apparatus 302, the safeguard apparatus 305 outputs a command to the press controller 190 in order to apply sudden braking to the slide 110. In response to this command, the position of the slide (connecting rod point) which depends on the crank angle, comes to a sudden stop (FIG. 19).

However, the slide (connecting rod point) position descends approximately by 40 mm due to the inertia of the entire movable portion moving in conjunction with the slide 110 and stops at 155 mm.

Figure 21:
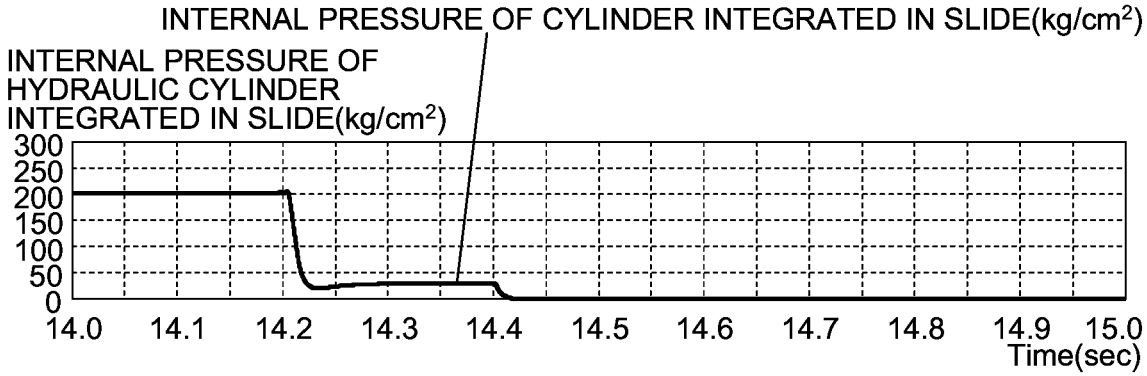
FIG. 21 is a partial enlarged view of the waveform diagram illustrated in FIG. 17 showing mainly the timing when a double blank is detected.
Figure 22:
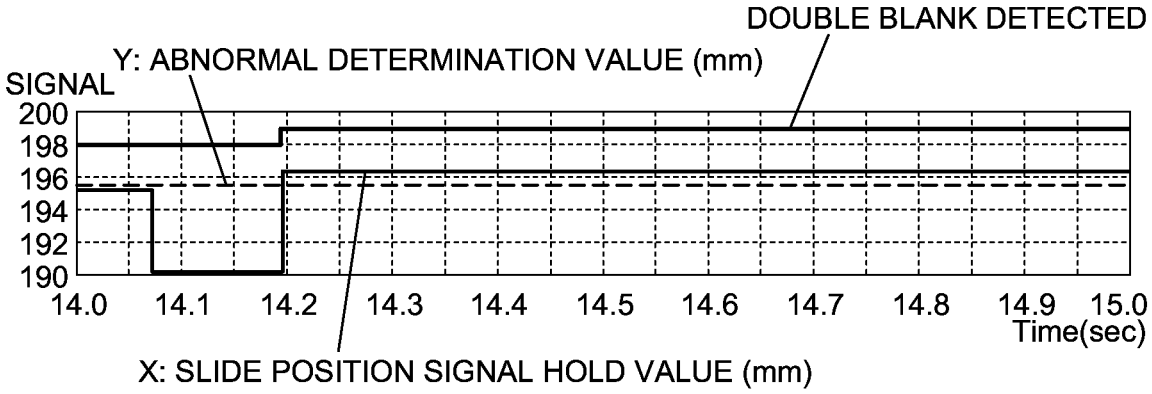
FIG. 22 is a partial enlarged view of the waveform diagram illustrated in FIG. 18 showing mainly the timing when a double blank is detected.

Simultaneously, the safeguard apparatus 305 outputs a command to the solenoid (depressurizing) valve 228 via the selector 198 in order to depressurize the head-side hydraulic chambers of the hydraulic cylinders 107R and 107L integrated in the slide. In response to this command, the head-side hydraulic chambers are suddenly depressurized (FIG. 21). In order to enhance the sudden depressurizing action, a valve having a large opening degree (flow rate coefficient) and high-speed responsiveness is selected as the solenoid valve 228. In addition, in order to enhance responsiveness, the voltage to be applied at the start of ON (excitation) is instantaneously increased (an improvement is made to advance the phase of an approximately first-order lag characteristic in association with the action of the electromagnetic force of the solenoid valve).

Simultaneously, the safeguard apparatus 305 outputs to the pressure controller 134, the die cushion load command for causing the die cushion load of the maximum capacity, that is, 3000 kN, to act on the cushion pad 128 in order to rapidly contract the depressurized head-side hydraulic chambers. In response to this command, the die cushion load command changes immediately to 3000 kN (dot line in FIG. 20). The pressure in the head-side hydraulic chambers of the hydraulic cylinders integrated in the slide is lowered to approximately 20 kg/cm$^2$ about 30 ms after, that is, when the slide (connecting rod point) position reaches approximately 185 mm (near 14.225 s in FIG. 21).

Figure 20:
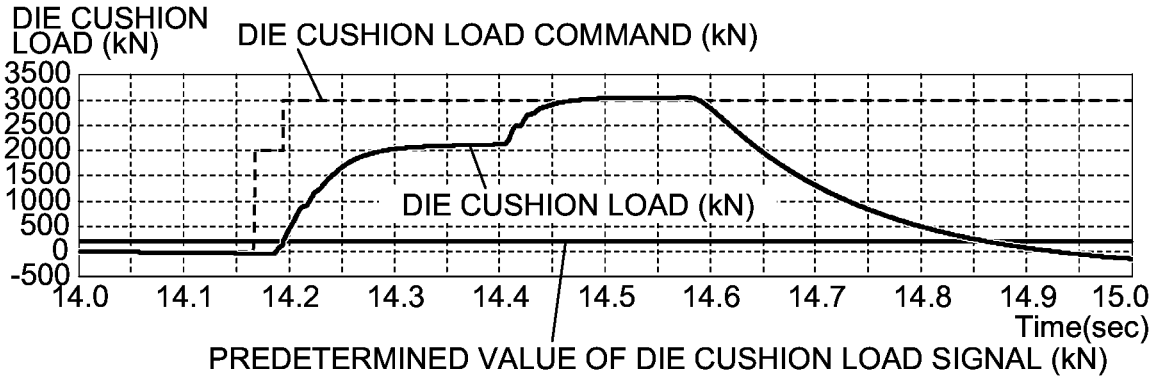
FIG. 20 is a partial enlarged view of the waveform diagram illustrated in FIG. 16 showing mainly the timing when a double blank is detected.

From then onward, the hydraulic cylinders 107R and 107L start to contract, the die mounting position of the slide (lower surface) which is liked with the contraction is inverted (changes the moving direction from downward to upward). A part including the die mounting surface of the slide moves relatively in the ascending direction (the dot line in FIG. 19). At this time, the die cushion load is affected by a speed reduction of the lower surface of the slide which is pressing the die cushion, and is temporarily stabilized to the order of 2000 kN which is smaller than the command 3000 kN (FIG. 20). At this time, the hydraulic cylinders 107R and 107L are pushed indirectly from below by the die cushion load, and continue to contract while discharging hydraulic oil.

Approximately 25 kg/cm$^2$ which corresponds to the pressure loss caused when the discharged oil flows through the solenoid valve 228 acts on the head-side hydraulic chambers of the hydraulic cylinders 107R and 107L. The hydraulic cylinders 107R and 107L reach the contraction (mechanical) limit near the 14.3 to 14.4 seconds illustrated in FIG. 21, the oil is not discharged any longer, and the pressure in the head-side hydraulic chambers is lowered to substantially zero. In addition, the speed of the lower surface of the slide becomes equal to a predetermined slide speed, so that the die cushion load is changed to 3000 kN as commanded (FIG. 20). In this state, the slide (the position of the connecting rod point) still continues to move slightly downward (FIG. 19), and control of the die cushion load ends (FIG. 20).

With this series of actions, the lowest position of the die mounting position of the slide (lower surface) is approximately 185 mm (near 14.26 seconds and near 15 seconds in FIG. 19), and this position corresponds to when the press machine is in the state illustrated in the left half of in FIG. 7. The left half in FIG. 7 illustrates the state of the press machine at a moment immediately before the blank 80 comes into contact with the lower die 122 (punch) and the forming starts. When the double blank is detected by the die protecting function, the machine is safely stopped in advance (before forming).

In this manner, only in a case where the position of the lower surface of the slide is in a range where the forming is not started even if the effect of contraction of the hydraulic cylinders 107R and 107L is considered, the hydraulic cylinders 107R and 107L are caused to rapidly contract. Therefore, the maximum die cushion load is made to act continuously on the hydraulic cylinders 107R and 107L until the contraction is completed. A double blank is a state in which two blanks are stacked one on another and is extremely dangerous for the die. In a case where the double blank is detected, the die cushion load is basically not applied in the press-forming region.

In case where the press machine is emergently stopped in the press-forming region during the operation with a cause other than the double blank, such as a case where a light-beam type safety apparatus is shielded, the situation is different from the case where the double blank occurs. In the emergently stop other than the double blank, the situation is different from a case where a predetermined die cushion load is applied in order to suppress the die from being damaged due to generation of drawing wrinkling until the slide stops.

<Others>

In this embodiment, the die protecting apparatus 300 including the double-blank detecting apparatus 302 and the safeguard apparatus 305 is integrated in the die cushion controller 170. However, the present invention is not limited thereto. The die protecting apparatus 300 may be provided outside the die cushion controller 170.

In addition, the present invention may be configured to include only the double-blank detecting apparatus. In this case, a safeguard apparatus other than that in this embodiment may be applied as the safeguard apparatus used when a double blank is detected. It should be noted that the double-blank detecting apparatus according to the present invention can also detect a state where three or more blanks are stacked.

In addition, it is preferable to immediately stop a conveying apparatus which sets blank 80 to the press machine 100 in case where a double blank is detected by the double-blank detecting apparatus 302.

In addition, in this embodiment, the cushion pad is supported by two hydraulic cylinders. However, the number of the hydraulic cylinders is not limited to two. The number of hydraulic cylinders may be one, or more than two. The die cushion driving unit is not limited to a configuration using the hydraulic cylinder. The die cushion driving unit may be of any type which supports the cushion pad, moves the cushion pad upward and downward, and generates a desired die cushion load in the cushion pad.

It should be noted that the hydraulic cylinder integrated in the slide may use oil as the hydraulic fluid. However, the hydraulic fluid is not limited thereto. Hydraulic cylinders using water or other fluids may also be used in the present invention.

Further, it is needless to say that the present invention is not limited to the embodiment described above, and various modifications may be made without departing the spirit of the present invention.

What is claimed is:

1. A double-blank detecting apparatus for a press machine that is provided with a die cushion apparatus and forms blanks one by one automatically and repeatedly, the double-blank detecting apparatus comprising:

a slide position detector configured to detect a position of a slide of the press machine and output a slide position signal;

a die cushion load detector configured to detect a die cushion load generated on a cushion pad and output a die cushion load signal; and a double-blank detector configured to detect a state in which a plurality of blanks are stacked as a double blank based on the slide position signal and the die cushion load signal, wherein the double-blank detector holds the slide position signal at a timing when the die cushion load signal rises to a predetermined value as a slide position signal hold value, compares the held slide position signal hold value and an abnormality determination value, and detects the double blank in a case where the held slide position signal hold value is equal to or larger than the abnormality determination value, and the predetermined value of the die cushion load signal is a value within a range from 5% or more and 20% or less of a maximum die cushion load of the die cushion apparatus.

2. The double-blank detecting apparatus for a press machine according to claim 1, wherein the abnormality determination value is set so as to satisfy conditions of $$Y \geq (X_{AVE}+0.3T) \text{ and } Y<(X_{AVE}+T)$$

in which Y is the abnormality determination value, $X_{AVE}$ is an average value of slide position signal hold values obtained by repeating forming of one blank by a plurality of times, and T is a plate thickness of the blank.

3. The double-blank detecting apparatus for a press machine according to claim 1, wherein the abnormality determination value is set so as to satisfy conditions of $$Y<X', \text{ and } Y \geq (X'-0.7T)$$

in which Y is the abnormality determination value, X' is a slide position signal hold value obtained by testing forming of two stacked blanks, and T is a plate thickness of the blank.

4. A die protecting apparatus for a press machine which is provided with a die cushion apparatus and forms blanks one by one automatically and repeatedly, the press machine including a braking apparatus configured to apply brake on a slide driven by a press driving apparatus of the press machine, and a hydraulic cylinder integrated in the slide and configured to move a die mounting surface of the slide relatively to a movement of the slide driven by the press driving apparatus, the die protecting apparatus comprising:

the double-blank detecting apparatus according to claim 1; and a safeguard apparatus configured to cause the braking apparatus to start a sudden braking of the slide and depressurize the hydraulic cylinder to relatively move a part of the slide including the die mounting surface in an ascending direction when double blank is detected by the double-blank detector.

5. A press machine which forms blanks one by one automatically and repeatedly, the press machine comprising:

the die protecting apparatus according to claim 4; and a die cushion apparatus, wherein the die cushion apparatus comprises:

a die cushion driving unit configured to support a cushion pad, move the cushion pad upward and downward, and generate a die cushion load on the cushion pad;

a die cushion load command unit configured to output a die cushion load command; and a die cushion load controller configured to control the die cushion driving unit based on the die cushion load command output from the die cushion load command unit to generate on the cushion pad, a die cushion load corresponding to the die cushion load command, wherein, in a case where the double blank is detected by the double-blank detector, and only when the cushion pad is in a region where forming does not start, of a region where the cushion pad moves, and the die cushion load command unit outputs a predetermined die cushion load command until the slide stops, make the hydraulic cylinder contract by a die cushion load generated on the cushion pad in accordance with the die cushion load command to move a part of the slide including a die mounting surface relatively in an ascending direction.

6. The press machine according to claim 5, wherein the die cushion apparatus comprises:

a die cushion position command unit configured to output a die cushion position command; and a die cushion position controller configured to control the die cushion driving unit based on the die cushion position command output from the die cushion position command unit after the die cushion load control by the die cushion load controller is finished, to move the cushion pad upward to a predetermined die cushion standby position, wherein the predetermined die cushion standby position is a position shifted in the ascending direction by a predetermined amount from a position where forming starts.

7. The press machine according to claim 6, wherein the region where the forming does not start is a region between the predetermined die cushion standby position and the position where the forming starts.

8. The press machine according to claim 5, wherein the die cushion load command unit automatically outputs a maximum die cushion load command as the predetermined die cushion load command when the double blank is detected by the double-blank detector.

* * * * *